US011602828B2

(12) United States Patent
Kukucka et al.

(10) Patent No.: US 11,602,828 B2
(45) Date of Patent: Mar. 14, 2023

(54) MULTI-GRIP SCREW APPARATUS

(71) Applicant: GRIP HOLDINGS LLC, Brandon, FL (US)

(72) Inventors: Paul Kukucka, Brandon, FL (US); Thomas Stefan Kukucka, Brandon, FL (US)

(73) Assignee: GRIP HOLDINGS LLC, Brandon, FL (US)

( * ) Notice: Subject to any disclaimer, the term of this patent is extended or adjusted under 35 U.S.C. 154(b) by 0 days.

(21) Appl. No.: 17/506,590

(22) Filed: Oct. 20, 2021

(65) Prior Publication Data

US 2022/0040830 A1 Feb. 10, 2022

Related U.S. Application Data

(63) Continuation-in-part of application No. 17/224,032, filed on Apr. 6, 2021, which is a continuation-in-part of application No. PCT/IB2019/056500, filed on Jul. 30, 2019.

(51) Int. Cl.

| | |
|---|---|
| ***B25B 23/10*** | (2006.01) |
| ***B25B 23/00*** | (2006.01) |
| ***B25B 15/00*** | (2006.01) |

(52) U.S. Cl.

CPC ..... *B25B 23/108* (2013.01); *B25B 15/008* (2013.01); *B25B 23/0035* (2013.01)

(58) Field of Classification Search

CPC .. B25B 23/108; B25B 23/0035; B25B 15/008

USPC ..... 81/436

See application file for complete search history.

(56) References Cited

U.S. PATENT DOCUMENTS

| | | | |
|---|---|---|---|
| 1,798,944 | A | 3/1931 | Jackman |
| 3,405,377 | A | 10/1968 | Pierce |
| 3,495,485 | A | 2/1970 | Knudsen et al. |
| 3,902,384 | A | 9/1975 | Ehrler |
| 3,908,489 | A | 9/1975 | Yamamoto et al. |
| 4,074,597 | A | 2/1978 | Jansson |
| 4,598,616 | A | 7/1986 | Colvin |
| 4,607,547 | A | 8/1986 | Martus |
| 4,893,530 | A | 1/1990 | Warheit |

(Continued)

FOREIGN PATENT DOCUMENTS

| | | |
|---|---|---|
| AU | 201612229 | 4/2016 |
| AU | 201612720 | 6/2016 |

(Continued)

*Primary Examiner* — Hadi Shakeri

(57) ABSTRACT

A screw bit body allows for efficient torque force application onto a socket fastener. The screw bit body includes a plurality of laterally-bracing sidewalls, a first base, and a second base. The laterally-bracing sidewalls are radially distributed about a rotation axis of the screw bit body with each further including a first lateral edge, a second lateral edge, a bracing surface, and an engagement cavity. The engagement cavity creates an additional gripping point to prevent slippage in between the screw bit body and the socket fastener. The engagement cavity traverses normal and into the bracing surface. Additionally, the engagement cavity traverses into the screw bit body from the first base to the second base. The engagement cavity is specifically positioned offset from the first lateral edge by a first distance.

10 Claims, 22 Drawing Sheets

(56) References Cited

U.S. PATENT DOCUMENTS

| | | | |
|---|---|---|---|
| 4,927,020 | A | 5/1990 | Randy |
| 4,930,378 | A | 6/1990 | Colvin |
| 5,019,080 | A | 5/1991 | Hemer |
| 5,219,392 | A | 6/1993 | Ruzicka et al. |
| 5,228,570 | A | 7/1993 | Robinson |
| 5,251,521 | A | 10/1993 | Burda et al. |
| 5,398,823 | A | 3/1995 | Anders |
| 5,481,948 | A | 1/1996 | Zerkovitz |
| 5,501,342 | A | 3/1996 | Geibel |
| 5,519,929 | A | 5/1996 | Bleckman |
| 5,645,177 | A | 7/1997 | Lin |
| 5,669,516 | A | 9/1997 | Horn |
| 5,725,107 | A | 3/1998 | Dembicks |
| 5,743,394 | A | 4/1998 | Martin |
| 5,782,148 | A | 7/1998 | Kerkhoven |
| 5,829,327 | A | 11/1998 | Stanton |
| 5,832,792 | A | 11/1998 | Hsieh |
| 5,868,049 | A | 2/1999 | Kanwal |
| 6,009,778 | A | 1/2000 | Hsieh |
| 6,092,279 | A | 7/2000 | Shoup |
| 6,352,011 | B1 | 3/2002 | Fruhm |
| 6,431,373 | B1 | 8/2002 | Blick |
| 6,575,057 | B1 | 6/2003 | Ploeger |
| 6,698,316 | B1 | 3/2004 | Wright |
| 6,755,098 | B2 | 6/2004 | Huang |
| 6,761,089 | B2 | 7/2004 | Bergamo |
| 6,857,340 | B2 | 2/2005 | Wagner |
| 6,951,156 | B2 | 10/2005 | Garg |
| 7,000,501 | B1 | 2/2006 | Chen |
| D524,615 | S | 7/2006 | Albertson |
| 7,225,710 | B2 | 6/2007 | Pacheco, Jr. |
| 7,331,260 | B2 | 2/2008 | Cheng |
| 7,717,278 | B2 | 1/2010 | Kao |
| D614,931 | S | 5/2010 | Su |
| 7,788,994 | B2 | 9/2010 | Wright et al. |
| 7,841,480 | B2 | 11/2010 | Hsieh |
| 7,913,593 | B2 | 3/2011 | Dahar et al. |
| 8,166,851 | B2 | 5/2012 | Pchola |
| 8,302,255 | B2 | 11/2012 | Lin |
| 8,336,709 | B1 | 12/2012 | Geibel |
| D745,814 | S | 12/2015 | Hsieh |
| 9,718,170 | B2 | 8/2017 | Eggert |
| 9,873,195 | B1 | 1/2018 | Buxton |
| 9,878,441 | B1 | 1/2018 | Kao |
| D829,069 | S | 9/2018 | Doroslovac et al. |
| 10,081,094 | B2 | 9/2018 | Doroslovac et al. |
| 10,100,864 | B2 * | 10/2018 | Rathmann ..... F16B 23/003 |
| D859,944 | S | 9/2019 | Kukucka et al. |
| D859,945 | S | 9/2019 | Kukucka et al. |
| D859,946 | S | 9/2019 | Kukucka et al. |
| D859,947 | S | 9/2019 | Kukucka et al. |
| D867,841 | S | 11/2019 | Kukucka et al. |
| D868,553 | S | 12/2019 | Kukucka et al. |
| D879,577 | S | 3/2020 | Kukucka et al. |
| D880,968 | S | 4/2020 | Kukucka et al. |
| D880,977 | S | 4/2020 | Kukucka et al. |
| D885,149 | S | 5/2020 | Kukucka et al. |
| D887,233 | S | 6/2020 | Kukucka et al. |
| D887,711 | S | 6/2020 | Kukucka et al. |
| D889,224 | S | 7/2020 | Kukucka et al. |
| D889,257 | S | 7/2020 | Kukucka et al. |
| D892,578 | S | 8/2020 | Kukucka et al. |
| 10,780,556 | B2 | 9/2020 | Kukucka et al. |
| 10,786,890 | B2 | 9/2020 | Kukucka et al. |
| D899,091 | S | 10/2020 | Kukucka et al. |
| 10,828,766 | B2 | 11/2020 | Kukucka et al. |
| D904,152 | S | 12/2020 | Kukucka et al. |
| D906,781 | S | 1/2021 | Kukucka et al. |
| 10,882,162 | B2 | 1/2021 | Kukucka et al. |
| D909,842 | S | 2/2021 | Kukucka et al. |
| D910,490 | S | 2/2021 | Lim et al. |
| 10,919,133 | B2 | 2/2021 | Kukucka et al. |
| 10,960,520 | B2 * | 3/2021 | Schulz ..... B25B 23/0035 |
| 10,967,488 | B2 | 4/2021 | Kukucka et al. |
| 2003/0209111 | A1 | 11/2003 | Huang |
| 2004/0256263 | A1 | 12/2004 | Shih |
| 2005/0098459 | A1 | 5/2005 | Gorman |
| 2005/0103664 | A1 | 5/2005 | Shih |
| 2005/0257357 | A1 | 11/2005 | Huang |
| 2006/0130618 | A1 | 6/2006 | Hsieh |
| 2006/0156869 | A1 | 7/2006 | Hsieh |
| 2006/0266168 | A1 | 11/2006 | Pacheco, Jr. |
| 2007/0005070 | A1 | 1/2007 | Kay et al. |
| 2007/0261519 | A1 | 11/2007 | Cheng |
| 2008/0235930 | A1 | 10/2008 | English |
| 2009/0007732 | A1 | 1/2009 | Hsieh |
| 2009/0120885 | A1 | 5/2009 | Kao |
| 2009/0220321 | A1 | 9/2009 | Sakamura |
| 2011/0056339 | A1 | 3/2011 | Su |
| 2011/0303052 | A1 | 12/2011 | Chen |
| 2012/0060656 | A1 | 3/2012 | Chang |
| 2013/0047798 | A1 | 2/2013 | Huang |
| 2013/0213193 | A1 * | 8/2013 | Lukes ..... B25B 15/005 81/436 |
| 2013/0263706 | A1 | 10/2013 | Safar |
| 2014/0260832 | A1 | 9/2014 | Hsiao |
| 2014/0331826 | A1 | 11/2014 | Campbell |
| 2014/0360321 | A1 | 12/2014 | Steinweg et al. |
| 2015/0135910 | A1 | 5/2015 | Eggert et al. |
| 2015/0266169 | A1 | 9/2015 | Campbell, II |
| 2015/0314429 | A1 | 11/2015 | Doroslovac |
| 2016/0067853 | A1 | 3/2016 | Neto |
| 2016/0136792 | A1 | 5/2016 | Harp |
| 2016/0223005 | A1 | 8/2016 | Rathmann |
| 2016/0339564 | A1 | 11/2016 | Chen |
| 2017/0282337 | A1 | 10/2017 | Johnson et al. |
| 2017/0312839 | A1 | 11/2017 | Moss et al. |
| 2017/0312897 | A1 | 11/2017 | Doroslovac et al. |
| 2018/0003241 | A1 | 1/2018 | Goss |
| 2018/0141192 | A1 | 5/2018 | Chang |
| 2018/0354022 | A1 | 12/2018 | Ross et al. |
| 2018/0354102 | A1 | 12/2018 | Kukucka et al. |
| 2019/0001469 | A1 | 1/2019 | Cho et al. |
| 2019/0015961 | A1 | 1/2019 | Kukucka et al. |
| 2019/0152033 | A1 | 5/2019 | Kukucka et al. |
| 2019/0283233 | A1 | 9/2019 | Kukucka et al. |
| 2019/0337131 | A1 | 11/2019 | Kukucka et al. |
| 2019/0375077 | A1 | 12/2019 | Kukucka et al. |
| 2020/0078908 | A1 | 3/2020 | Wu et al. |
| 2020/0298380 | A1 | 9/2020 | Doroslovac et al. |
| 2020/0376648 | A1 | 12/2020 | Kukucka et al. |
| 2020/0391360 | A1 | 12/2020 | Kukucka et al. |
| 2021/0039245 | A1 | 2/2021 | Kukucka et al. |

FOREIGN PATENT DOCUMENTS

| | | | |
|---|---|---|---|
| AU | 201612721 | | 6/2016 |
| CA | 2564093 | A1 | 4/2007 |
| CA | 168071 | | 12/2016 |
| CA | 2898480 | A1 | 7/2017 |
| CN | 2767068 | Y | 3/2006 |
| CN | 3630254 | | 6/2006 |
| CN | 201046555 | Y | 4/2008 |
| CN | 102395447 | | 3/2012 |
| CN | 102554833 | A | 7/2012 |
| CN | 303924849 | | 11/2016 |
| CN | 303956827 | | 12/2016 |
| CN | 303984883 | | 12/2016 |
| DE | 3911409 | A1 | 10/1990 |
| DE | 29613327 | U1 | 9/1996 |
| DE | 10321284 | A1 | 12/2004 |
| DE | 202010006146 | U1 | 7/2010 |
| DE | 102013021238 | A1 | 6/2015 |
| EP | 1371453 | A2 | 12/2003 |
| EP | 1731774 | A1 | 12/2006 |
| GB | 906839 | A | 9/1962 |
| GB | 1294764 | A | 11/1972 |
| JP | 2011143522 | | 7/2011 |
| JP | 2012157913 | | 10/2011 |
| JP | 2015180835 | A | 7/2017 |
| KR | 200149097 | Y1 | 7/1999 |
| RU | 2152870 | C1 | 7/2000 |
| RU | 2225786 | C2 | 1/2001 |
| RU | 45671 | U1 | 5/2005 |

(56) References Cited

FOREIGN PATENT DOCUMENTS

| | | | |
|---|---|---|---|
| RU | 58510 | U1 | 11/2006 |
| RU | 2387533 | C1 | 4/2010 |
| RU | 116398 | | 5/2012 |
| RU | 180548 | U1 | 6/2018 |
| SU | 16616 | A1 | 8/1930 |
| WO | WO9416862 | A1 | 8/1994 |
| WO | WO1996010932 | A1 | 4/1996 |
| WO | WO1996026870 | A1 | 9/1996 |
| WO | WO1996027745 | A1 | 9/1996 |
| WO | WO9710926 | | 3/1997 |
| WO | 9812982 | A1 | 4/1998 |
| WO | WO9932264 | | 7/1999 |
| WO | WO0166312 | A1 | 9/2001 |
| WO | WO2004002687 | A1 | 1/2004 |
| WO | WO2005070621 | | 8/2005 |
| WO | WO2006023374 | | 3/2006 |
| WO | WO2006130490 | A1 | 12/2006 |
| WO | WO2010007402 | A1 | 1/2010 |
| WO | WO2011109040 | A1 | 9/2011 |
| WO | WO2015082283 | A1 | 6/2015 |
| WO | 2015050942 | A1 | 9/2015 |
| WO | DM090809 | | 4/2016 |
| WO | WO2016051080 | A1 | 4/2016 |
| WO | DM091188 | | 5/2016 |
| WO | DM091189 | | 5/2016 |
| WO | WO2016174615 | A1 | 11/2016 |
| WO | WO2017178997 | | 10/2017 |
| WO | WO2018172831 | | 9/2018 |
| WO | WO2019012486 | | 1/2019 |
| WO | WO2019167032 | | 9/2019 |
| WO | WO2019175652 | | 9/2019 |
| WO | WO2020039281 | | 2/2020 |
| WO | WO2020039285 | | 2/2020 |
| WO | WO2020058777 | | 3/2020 |
| WO | WO2020152516 | | 7/2020 |
| WO | WO2020208608 | | 10/2020 |
| WO | WO2020225800 | | 11/2020 |
| WO | WO2021001696 | | 1/2021 |
| WO | WO2021019500 | | 2/2021 |
| WO | WO2021033152 | | 2/2021 |

* cited by examiner

MULTI-GRIP SCREW APPARATUS

The current application is a continuation-in-part (CIP) application of the U.S. non-provisional application Ser. No. 17/224,032 filed on Apr. 6, 2021. The U.S. non-provisional application is a CIP application of the U.S. non-provisional application Ser. No. 16/942,658 filed on Jul. 29, 2020. The U.S. non-provisional application Ser. No. 16/942,658 is a CIP application of the U.S. non-provisional application Ser. No. 16/107,842 filed on Aug. 21, 2018. The U.S. non-provisional application Ser. No. 16/942,658 is also a CIP application of the Patent Cooperation Treaty (PCT) application PCT/IB2019/056500 filed on Jul. 30, 2019.

FIELD OF THE INVENTION

The present invention generally relates to various tools designed for tightening or loosening fasteners, in particular bolts and nuts. More specifically, the present invention is an anti-slip multidirectional driver bit, designed to prevent damaging or stripping fasteners during the extraction or tightening process.

BACKGROUND OF THE INVENTION

Hex bolts, nuts, screws, and other similar threaded devices are used to secure and hold multiple components together by being engaged to a complimentary thread, known as a female thread. The general structure of these types of fasteners is a cylindrical shaft with an external thread and a head at one end of the shaft. The external thread engages a complimentary female thread tapped into a hole or a nut and secures the fastener in place, fastening the associated components together. The head receives an external torque force and is the means by which the fastener is turned, or driven, into the female threading. The head is shaped specifically to allow an external tool like a wrench to apply a torque to the fastener in order to rotate the fastener and engage the complimentary female threading to a certain degree. This type of fastener is simple, extremely effective, cheap, and highly popular in modern construction.

One of the most common problems in using these types of fasteners, whether male or female, is the tool slipping in the head portion, or slipping on or off the head portion. This is generally caused by either a worn fastener or tool, corrosion, overtightening, or damage to the head portion of the fastener. The present invention is a driving bit design that virtually eliminates slippage. The design uses a series of segmented portions that bite into the head of the fastener and allow for efficient torque transfer between the driving bit and the head portion of the fastener. The present invention eliminates the need for the common bolt extractors as they require unnecessary drilling and tools. With the development of electric screwdrivers, and drills, people have been using, power tools to apply the required torsional forces and remove various fasteners. The present invention provides for a single or double-sided driver end bit, thus allowing for torque to applied to the fastener in both clockwise and counterclockwise directions, thus tightening or loosening the fastener. Most driver end bits have a standardized one fourth inch hex holder and come in various configurations including but not limited to, square end, hex end, or star end.

DETAIL DESCRIPTIONS OF THE INVENTION

All illustrations of the drawings are for the purpose of describing selected versions of the present invention and are not intended to limit the scope of the present invention.

The present invention generally related to torque tool accessories. More specifically, the present invention is a multi-grip screw bit, also known as a screw bit or driver. The present invention allows for a higher torque to be applied to a fastener than a similarly sized conventional driver bit without damaging the head of the fastener or the bit tool. This is achieved through the use of a multitude of engagement features which effectively grip the head of the fastener. The present invention is a screw bit that is compatible with a variety of torque tools including, but not limited to, traditional drills, bit-receiving screwdrivers, socket wrenches, and socket drivers.

Figure 1:
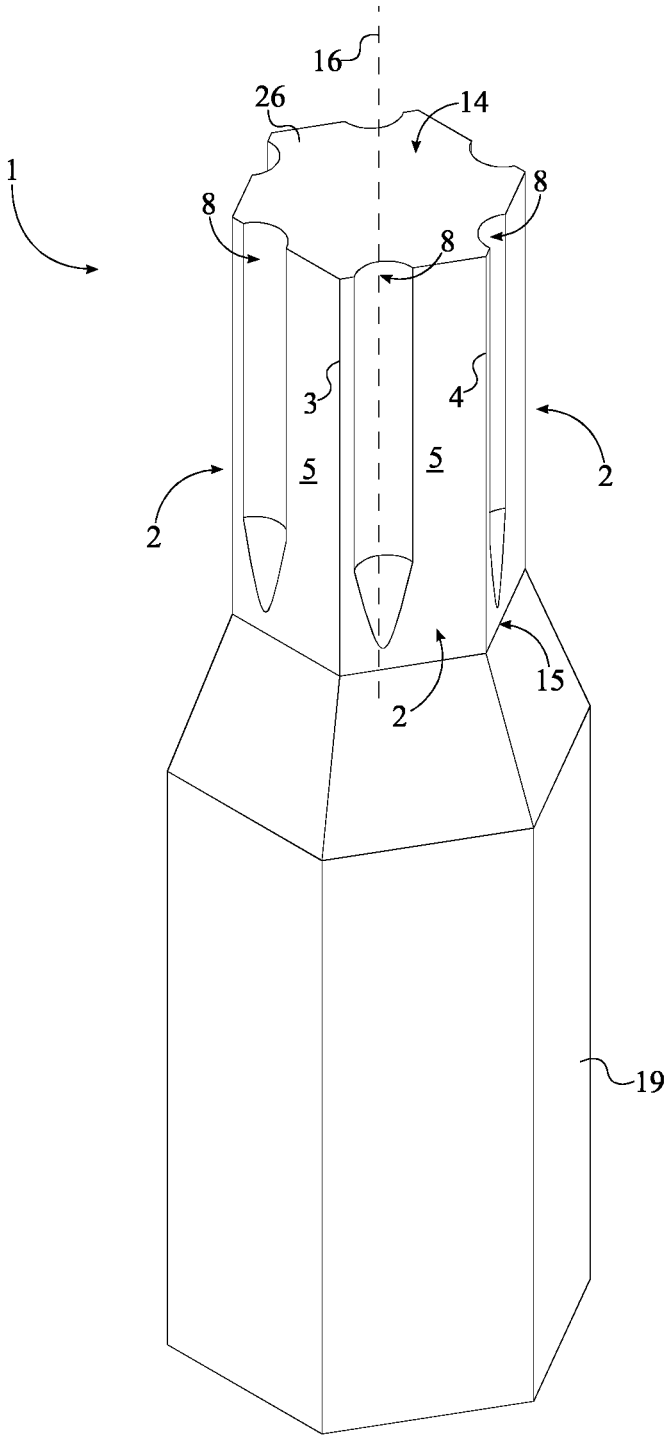
FIG. 1 is a perspective view of the present invention.

In its simplest embodiment, referring to FIG. 1, the present invention comprises an at least one screw bit body 1 and an attachment body 19. The screw bit body 1 is a shank which engages the socket fastener, such as a socket screw or a socket bolt, in order to apply a torque force onto the socket faster. The screw bit body 1 comprises a plurality of laterally-bracing sidewalls 2, a first base 14, a second base 15, and at least one engagement cavity 8. The at least one engagement cavity 8 is a generally lateral cut into the at least one screw bit body 1 that helps to distribute torsional forces applied during the preferred usage of the present invention in order to maximize efficiency and minimize wear. In general, the screw bit body 1 is a prism composed of a strong metal. Each of the plurality of laterally-bracing sidewalls 2 engage within and grip the socket fastener in order to efficiently transfer torque from a torque tool to the socket fastener. The first base 14 and the second base 15 are positioned opposite to each other along the plurality of laterally-bracing sidewalls 2. Additionally, the first base 14, and thus second base 15, is preferably oriented perpendicular to each of the plurality of laterally-bracing sidewalls 2 and thus enclose/complete the prism shape of the screw bit body 1. More specifically, it is preferred that the first base 14 comprises a first base surface 26, wherein the first base surface 26 is flat and is oriented perpendicular to the bracing surface 5 of each of the plurality of laterally-bracing sidewalls 2. The bracing surface 5 may further comprise a first portion 33. The first portion 33 is a section of the bracing surface 5 positioned along a first distance 21, which arranges the first portion 33 adjacent to the first lateral edge 3. The attachment body 19 allows the present invention to be attached to an external torque tool and, thus, allow torque force to be applied to the socket fastener through the screw bit body 1. The attachment body 19 is centrally positioned around and along a rotation axis 16 of the screw bit body 1 such that the rotation axis of the attachment body 19 and the rotation axis 16 of the screw bit body 1 are coincidentally aligned. Additionally, the attachment body 19 is connected adjacent to the second base 15. The attachment body 19 preferably has a hexagonal cross-section in order to fit within a female attachment member of the external torque tool. External torque tools include, but are not limited to, electric drills, torque wrenches, pneumatic drills, socket screw drivers, and other similar torque tools. The engagement cavity 8 preferably combines a curved portion with a straight portion but can alternatively be any shape as preferred by the user, including, but not limited to, a partially-circular, triangular or rectangular shape. Additionally, the shape of each portion of the engagement cavity 8 can be a shape from a group consisting of, straight line, and or concave, and or convex if preferred. The combination or singular use of these shapes could further improve the longevity, safety, and functionality of the present invention in certain applications as determined by the user. In an exemplary embodiment, the entire cross-section 9 of the at least one engagement cavity 8 is a triangular profile. This arrangement provides ample space while applying torque for relief of residual stresses and material that would otherwise strain the at least one engagement cavity 8. Furthermore, the triangular profile may be concave along a direction from the first lateral edge 3 to the second lateral edge 4. In this way, torqueing stresses are captured within the at least one engagement cavity 8 during the application of torsion. In another exemplary embodiment, the at least one engagement cavity 8 contains both curved and straight portions. This arrangement allows the at least one engagement cavity 8 to interact optimally with different fastener profiles, materials or different levels of stress during use.

Some embodiments are generally more advantageous for leverage and resistance of mechanical wear during use. To this end, the at least one engagement cavity 8 is positioned offset from the first lateral edge 3 of the at least one specific sidewall 36 by a first distance 21, as shown in FIGS. 9, 18, 19, 21 and 22. Resultantly, a gripping point is created by the at least one engagement cavity 8 and the bracing surface 5. The first portion 33 of the bracing surface 5 of the at least one specific sidewall 36 may be positioned along the first distance 21. In this way, the first distance 21 may denote area including a segment of the first portion 33. A width distance 35 of the at least one engagement cavity 8 may be positioned parallel to the bracing surface 5. This arrangement allows the width distance 35 to be parallel to the first distance 21. The width distance 35 may be greater than the first distance 21. In this way, the at least one engagement cavity 8 is ensured to span across a significant portion of the useful area for the bracing surface 5.

The first portion 33 of the present invention may take a variety of shapes as may be found to be advantageous under various stresses or use cases. To ensure an appropriate shape of the at least one engagement cavity 8, the first portion 33 may be a shape selected from the group consisting of: straight line, concave, and convex, as shown in FIG. 14 through 17. Any of these shapes could provide optimal support during use, improving the duration of the present invention.

The bracing surface 5 may further benefit from a more complex shape or arrangement. To enable this, the bracing surface 5 may further comprise a second portion 34, as shown in FIG. 14 through 17. The second portion 34 is a section of the bracing surface 5 positioned along a second distance 22, which arranges the second portion 34 adjacent to the second lateral edge 4. The at least one engagement cavity 8 may be positioned offset from the second lateral edge 4 of the at least one specific sidewall 36 by a second distance 22. The second distance 22 denotes the space opposite the first distance 21 between the at least one engagement cavity 8 and the second lateral edge 4. The second portion 34 of the bracing surface 5 of the at least one specific sidewall 36 may be positioned along the second distance 22. In this way, the second distance 22 may denote embodiment of the present invention, the number within the plurality of laterally-bracing sidewalls 2 is six and the resulting geometric profile of the screw bit body 1 is a hexagon. In an alternative embodiment of the present invention, the number within the plurality of laterally-bracing sidewalls 2 is four.

Figure 3:
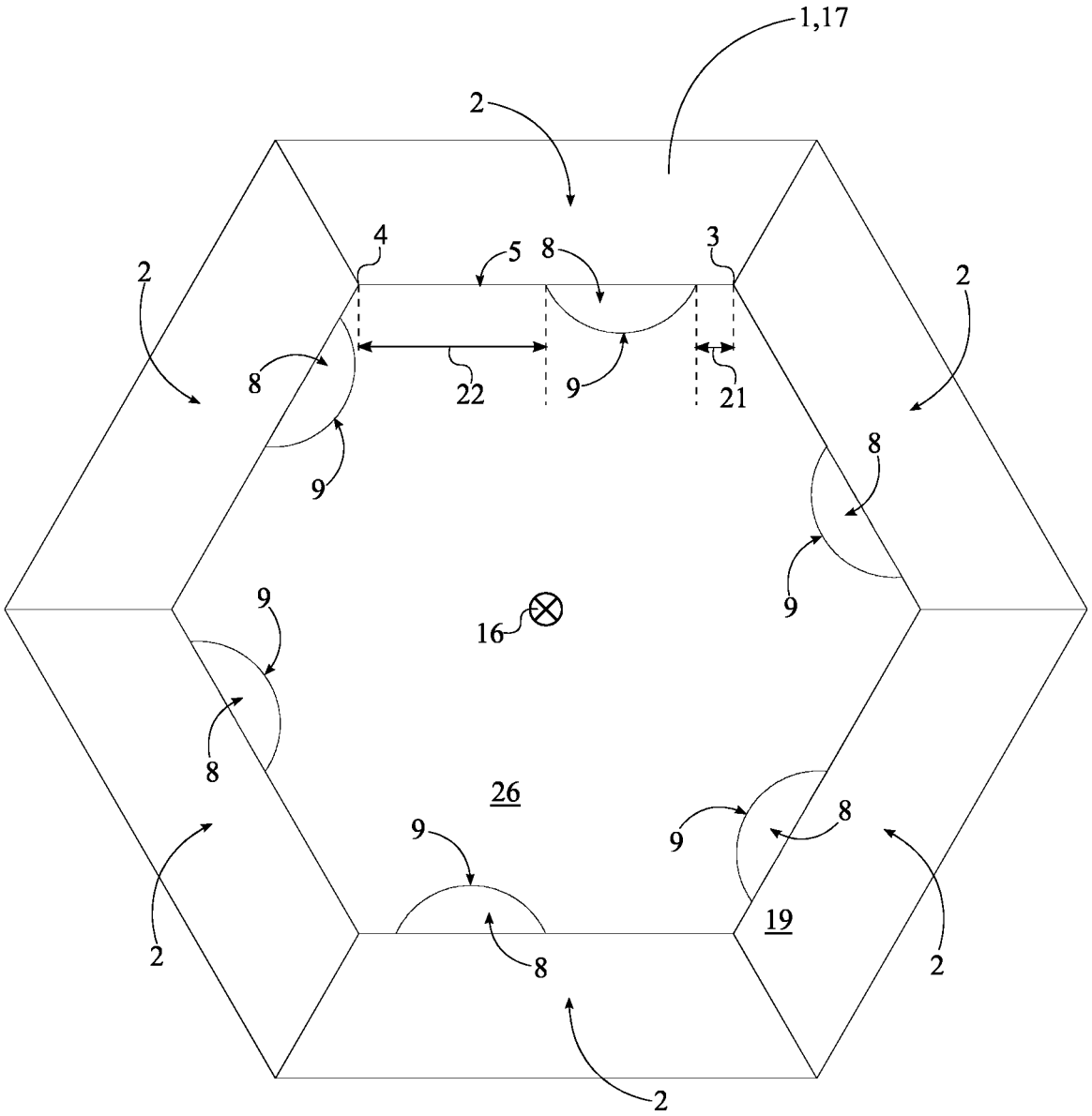
FIG. 3 is a front view of the alternative embodiment of the present invention in FIG. 2.
Figure 11:
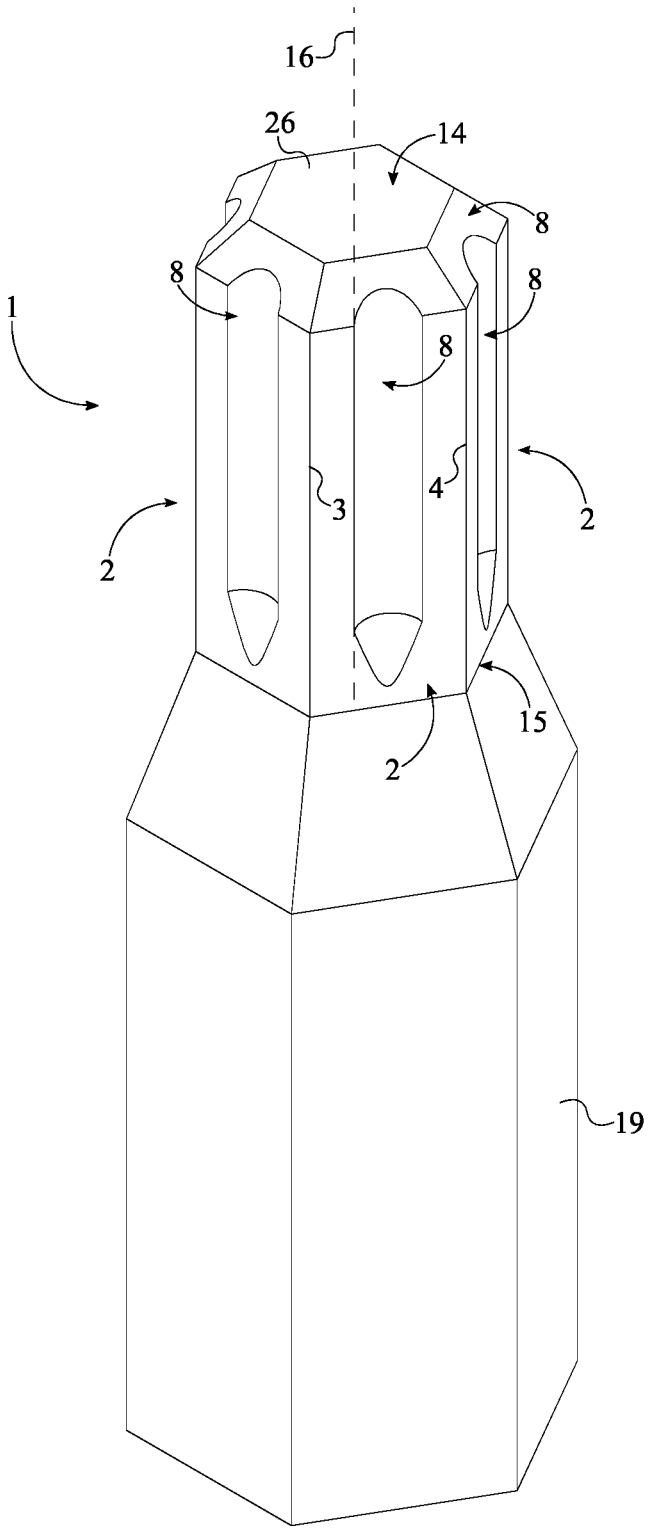
FIG. 11 is a perspective view of an alternative embodiment of the present invention.
Figure 13:
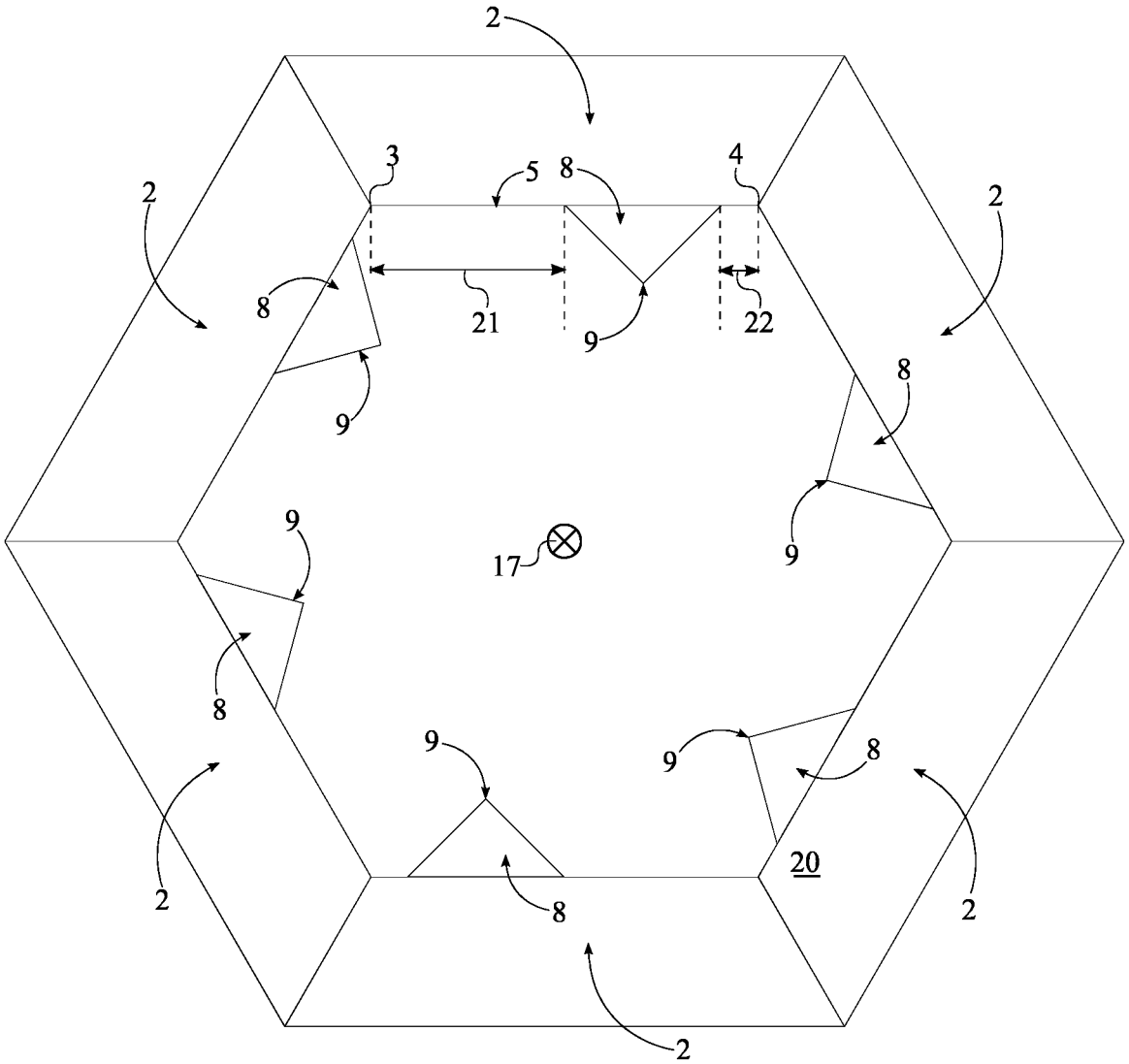
FIG. 13 is a front view of a separate alternative embodiment of the present invention in relation to FIG. 2, wherein an entire cross-section of the engagement cavity as a triangular profile.
Figure 14:
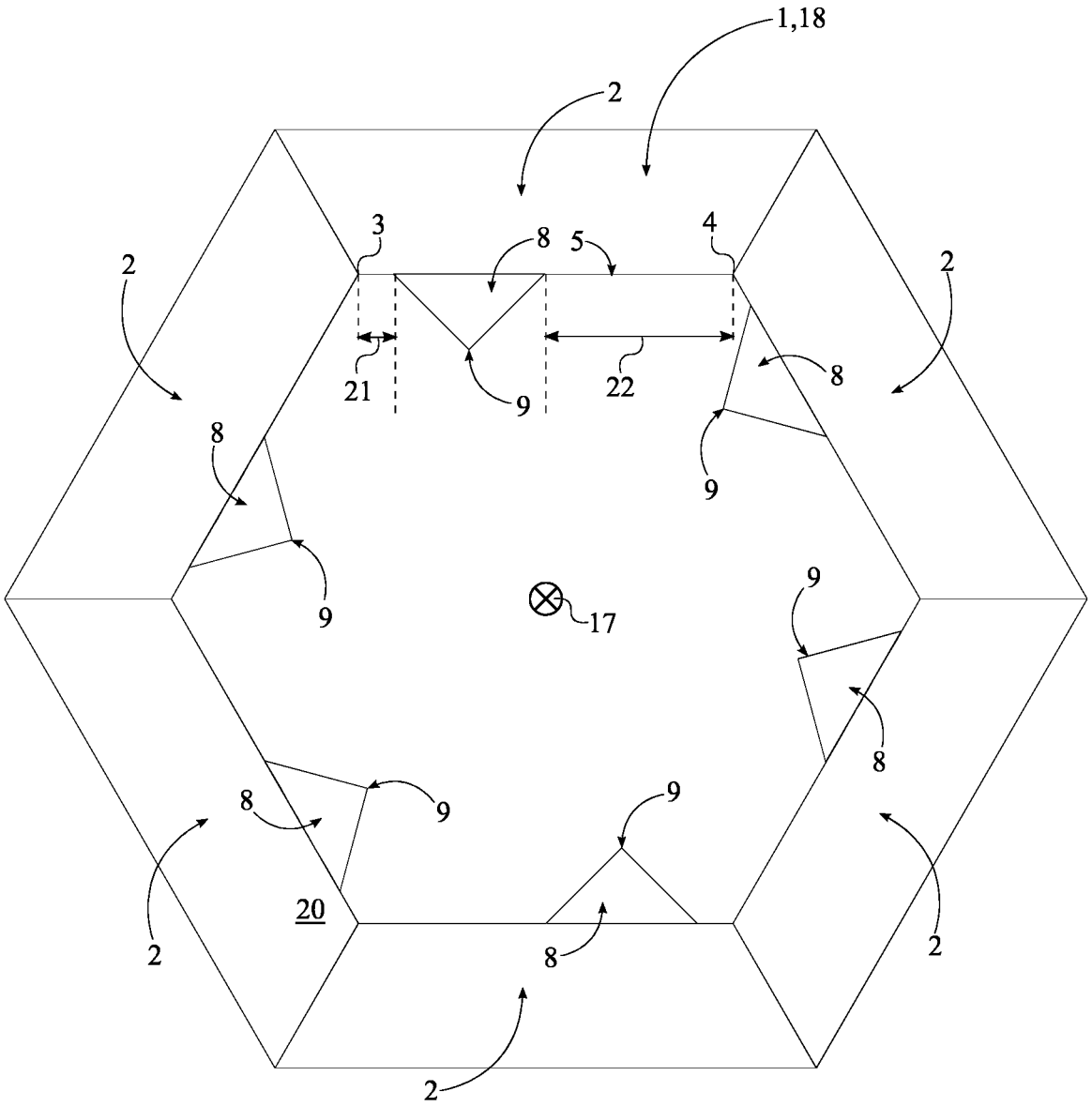
FIG. 14 is a rear view of the separate alternative embodiment of the present invention in relation to FIG. 2, wherein an entire cross-section of the engagement cavity as a triangular profile.

The bracing surface 5 physically presses against the socket fastener, specifically against the lateral sidewall of a head portion from the socket fastener. The first lateral edge 3 and the second lateral edge 4 are positioned opposite to each other across the bracing surface 5. When viewed from either the top perspective or the bottom perspective, the first lateral edge 3 and the second lateral edge 4 from each of the plurality of laterally-bracing sidewalls 2 make up the corners of the screw bit body 1. The engagement cavity 8 extends normal and into the bracing surface 5 of at least one specific sidewall 36 from the plurality of laterally-bracing sidewalls 2 and creates an additional gripping point/tooth on the bracing surface 5. In another embodiment, the gripping point is created by the engagement cavity 8 and an adjacent edge, wherein the adjacent edge is either the first lateral edge 3 or the second lateral edge 4; in particular, the adjacent edge is the edge closest to the engagement cavity 8. Additionally, the engagement cavity 8 extends into the screw bit body 1 from the first base 14 towards the second base 15. This ensures that the additional gripping point extends along the length of the screw bit body 1 for maximum grip engagement between the screw bit body 1 and the socket fastener. To further accomplish this, it is preferred that an entire cross-section 9 of the engagement cavity 8 is parallel to the first base 14 and the second base 15. In some embodiments of the present invention, the at least one engagement cavity 8 also tapers from the first base 14 to the second base 15 as seen in FIG. 11. As a consequence of this embodiment, the at least one engagement cavity 8 may taper from the first base 14 to the second base 15 in such a way that the triangular profile adjacent to the first base 14 is larger than the triangular profile adjacent to the second base 15. In this way, the at least one engagement cavity 8 may be appropriately shaped to meet the needs and requirements of the user. Referring to FIG. 3, in one embodiment of the present invention, the entire cross-section 9 of the engagement cavity 8 is a partially-circular profile. Additionally, the partially-circular profile is concave along a direction from the first lateral edge 3 to the second lateral edge 4. The partially-circular profile ensures that there are little to no high stress points in the screw bit body 1, thus increasing the overall longevity of the tool. Referring to FIG. 13 and FIG. 14, in a separate embodiment of the present invention, the entire cross-section 9 of the engagement cavity 8 is a triangular profile. Additionally, the triangular profile is concave along a direction from the first lateral edge 3 to the second lateral edge 4. Alternative profiles may be used for the engagement cavity 8 including, but not limited to, a semi-square profile, a semi-rectangular profile, and a semi-oval profile.

Figure 8:
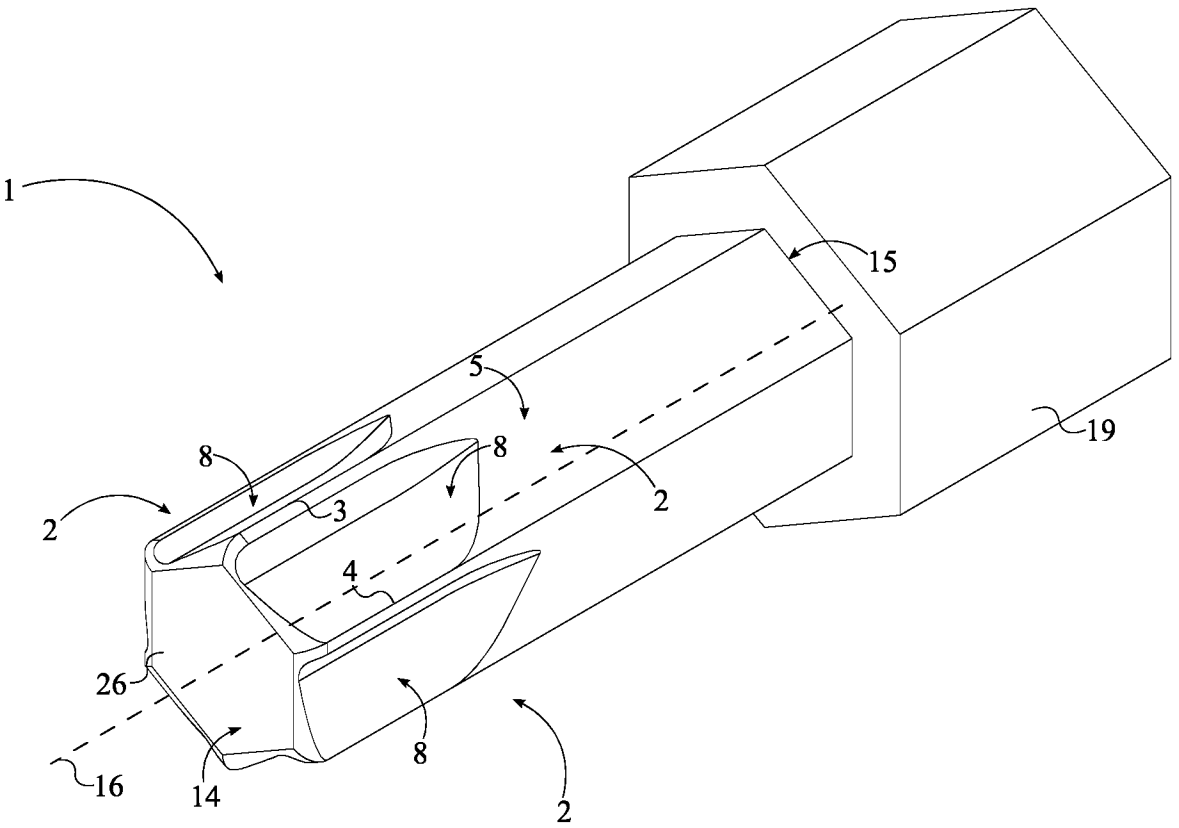
FIG. 8 is a perspective view of an alternative embodiment of the present invention.
Figure 9:
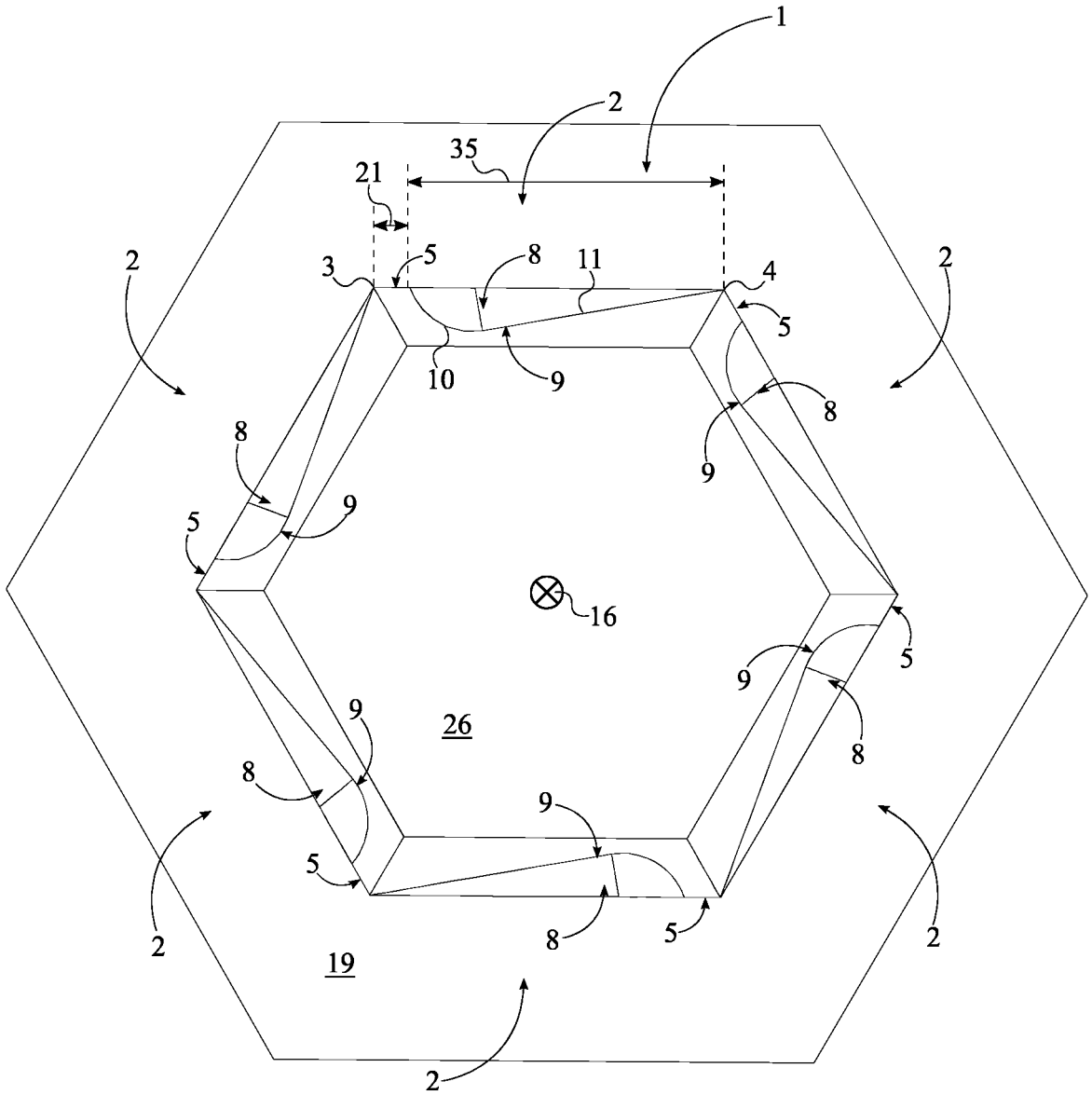
FIG. 9 is a front view of the alternative embodiment of the present invention in FIG. 8.

In one embodiment of the present invention, referring to FIG. 8 and FIG. 9, the entire cross-section 9 of the engagement cavity 8 comprises a curved portion 10 and a straight portion 11. In this embodiment, the present invention is implemented as an extraction bit, wherein the present invention is designed to extract damaged or broken fasteners, damaged rods, broken studs, and other similar items. The engagement cavity 8 is uniquely shaped in order to form a sharp engagement tooth that grips in the corners of the socket fastener, allowing material from the internal sides of the fastener socket into the engagement cavity 8 and thus yielding a superior grip over traditional tools which are simply designed to push material away. This is especially true for worn or damaged fastener socket. More specifically, the curved portion 10 is a semi-circular curve that is positioned adjacent to the first lateral edge 3. The curved portion 10 is positioned adjacent to the first portion 33 of the bracing surface 5 of the at least one specific sidewall 36, opposite the first lateral edge 3. This arrangement allows the first portion 33 to effectively position the curved portion 10 relative to the first distance 21. The straight portion 11 is positioned adjacent to the curved portion 10, opposite the first portion 33. The straight portion 11 guides a portion of the socket fastener to press against the engagement tooth. As such, the straight portion 11 extends from the curved portion 10 to the second lateral edge 4. Specifically, the straight portion 11 starts at the curved portion and ends at the second lateral edge 4.

Figure 15:
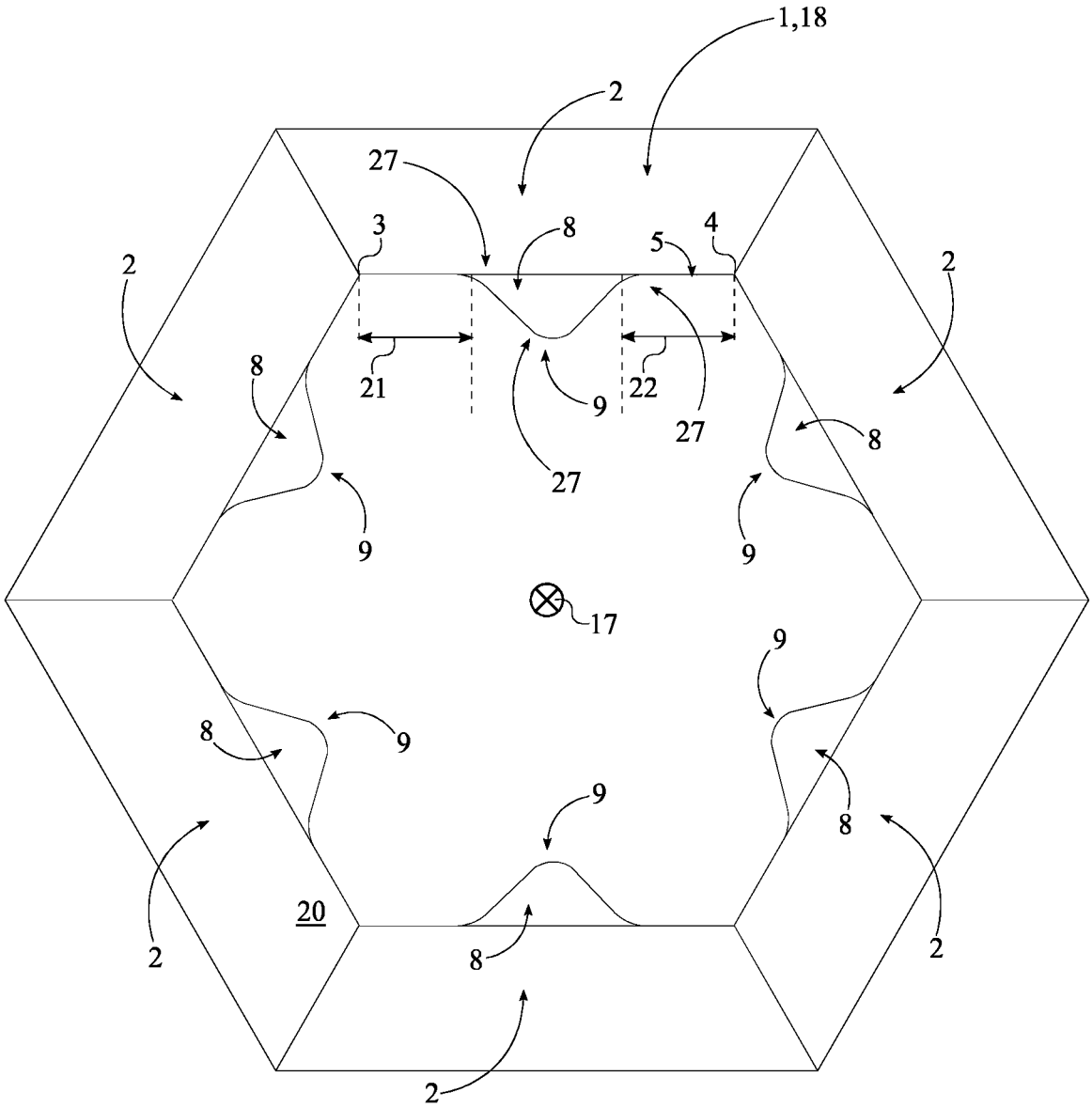
FIG. 15 is a front view of another separate alternative embodiment of the present invention in relation to FIG. 2, wherein an entire cross-section of the engagement cavity as a triangular profile.
Figure 16:
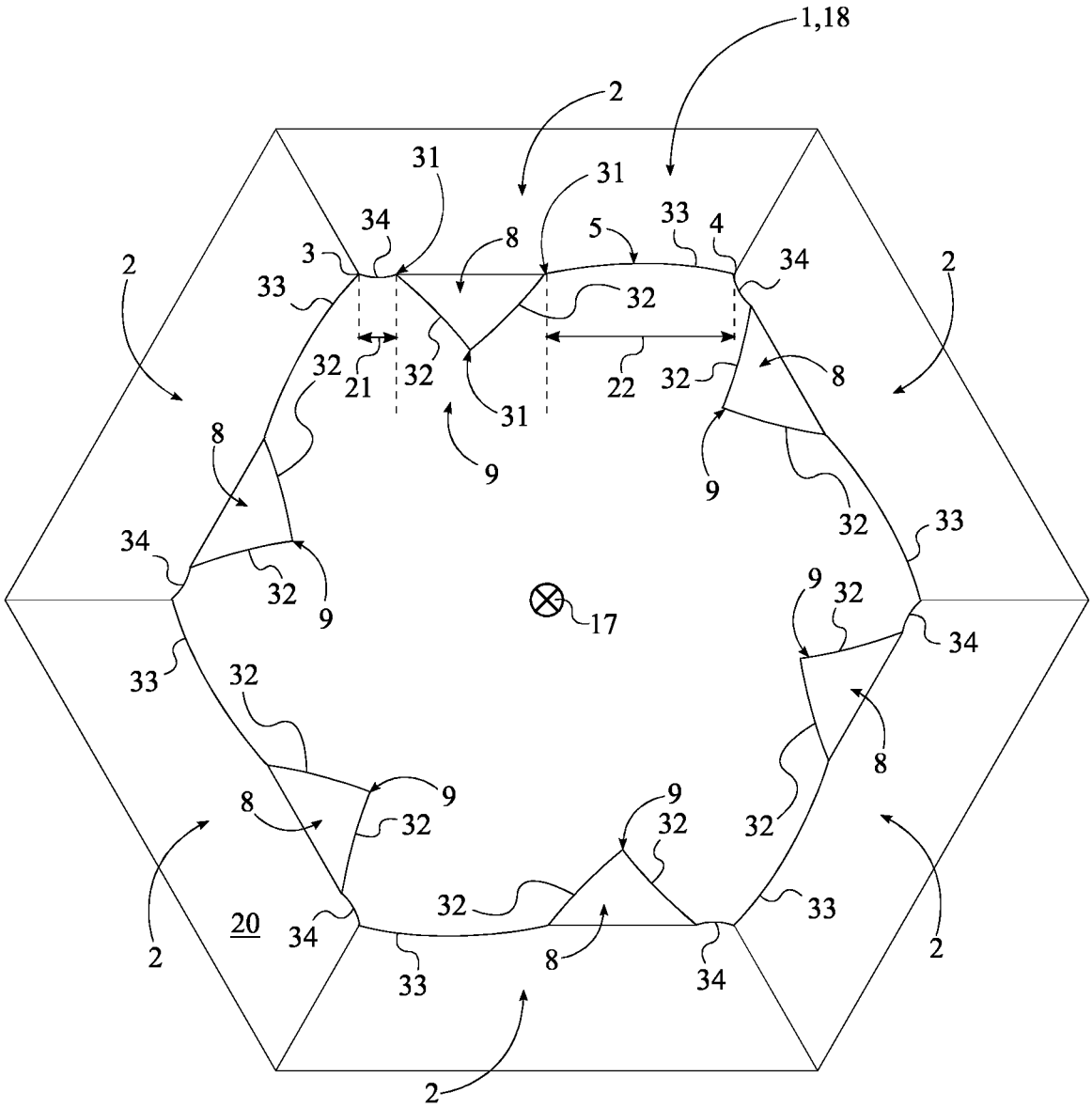
FIG. 16 is a front view of another separate alternative embodiment of the present invention in relation to FIG. 15, wherein different portions of a laterally-bracing sidewall are either concave or convex.
Figure 17:
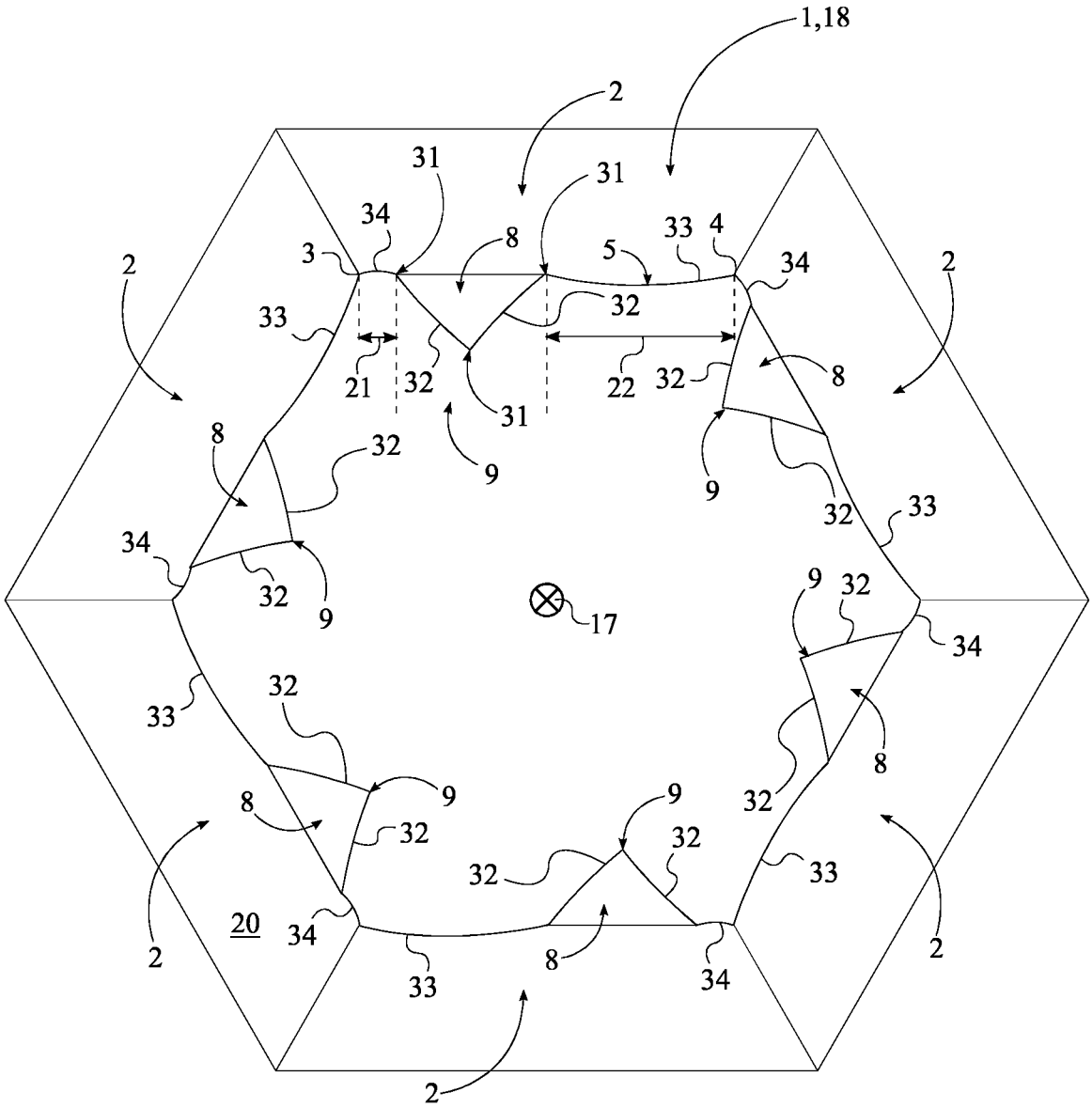
FIG. 17 is a front view of another separate alternative embodiment of the present invention in relation to FIG. 15, wherein different portions of a laterally-bracing sidewall are either convex or concave.
Figure 18:
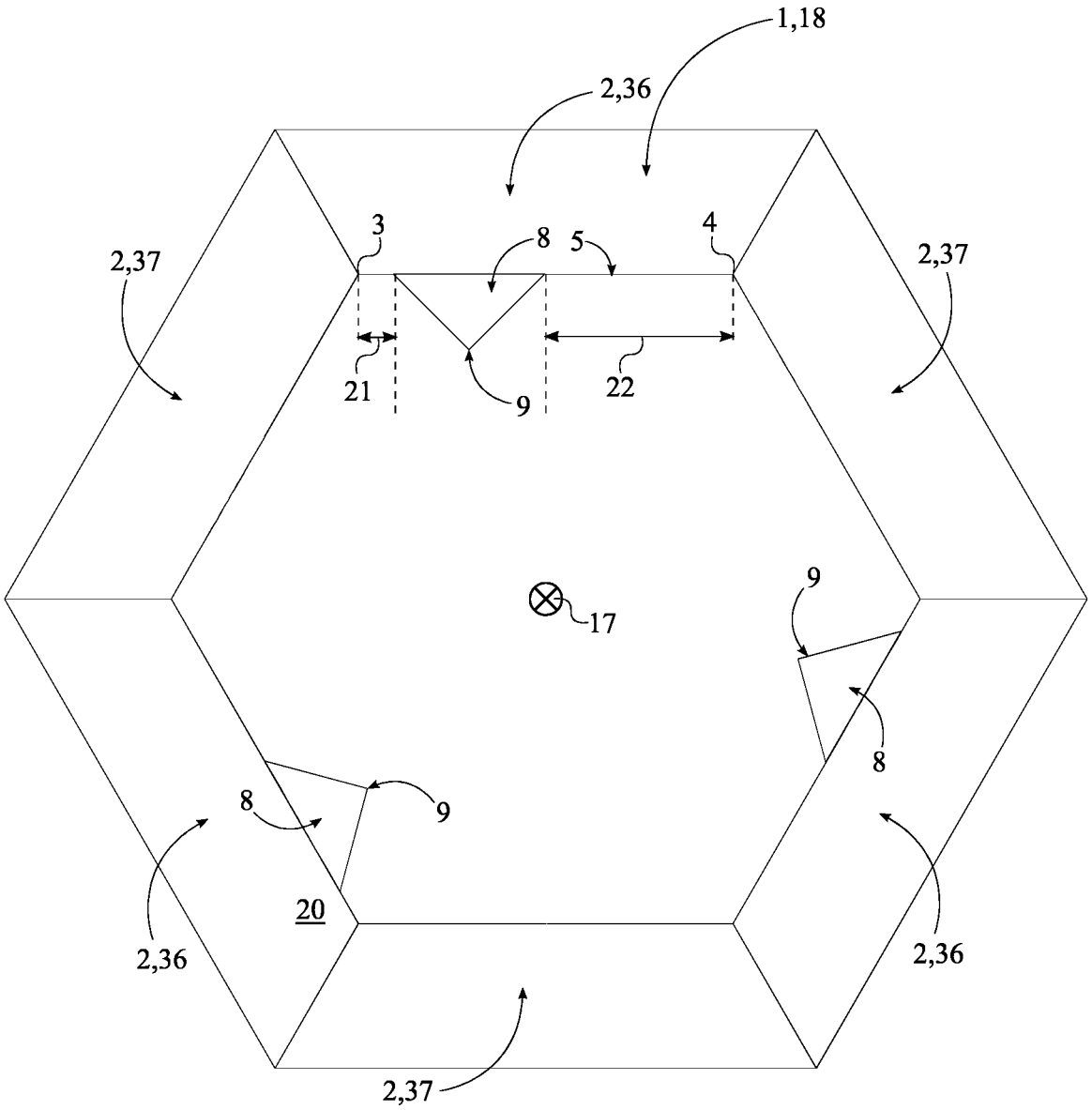
FIG. 18 is a front view of another separate alternative embodiment of the present invention in relation to FIG. 15, wherein engagement cavities are configured between flat sidewalls.
Figure 19:
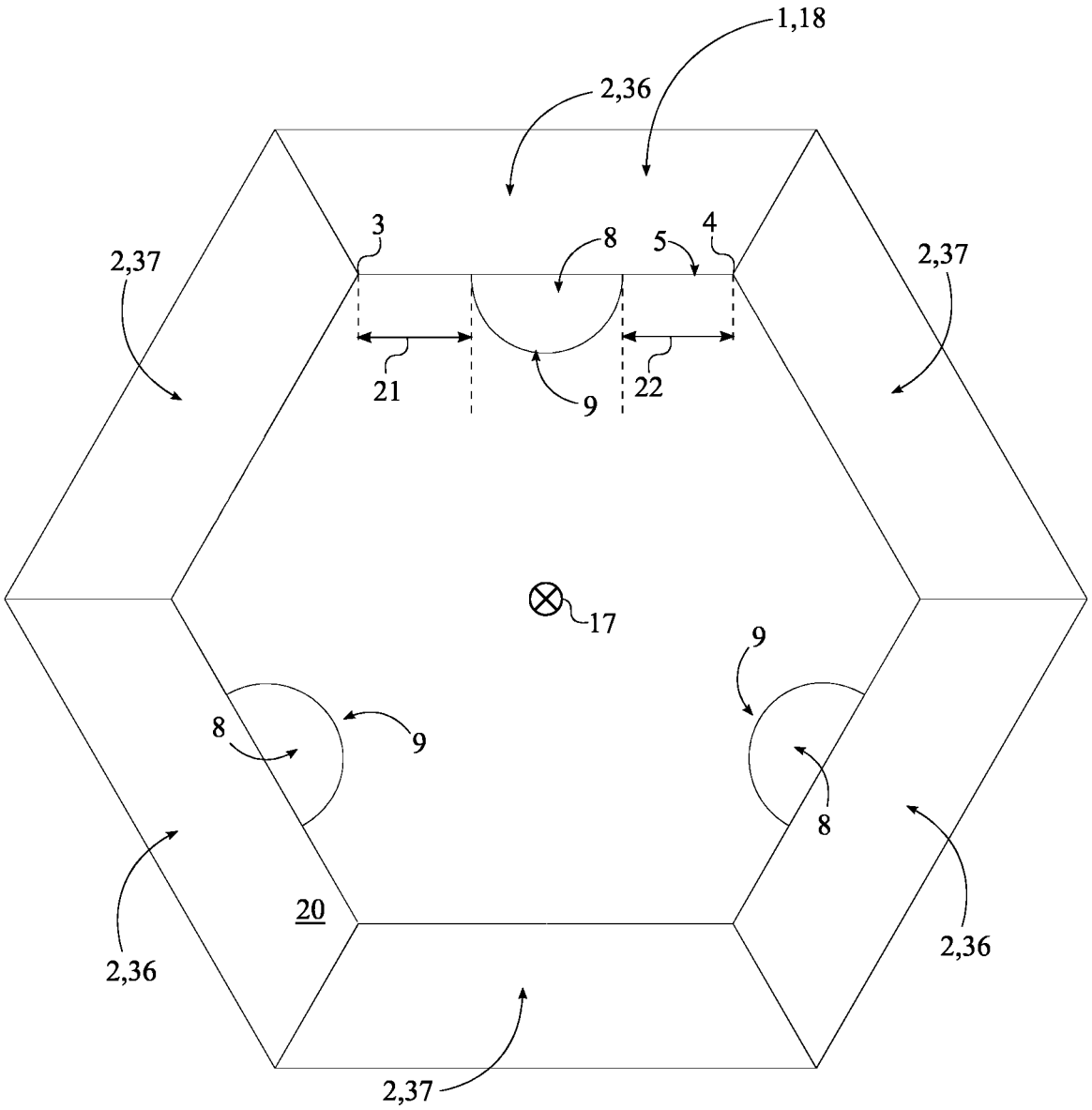
FIG. 19 is a front view of another separate alternative embodiment of the present invention in relation to FIG. 15, wherein engagement cavities are configured between flat sidewalls.
Figure 20:
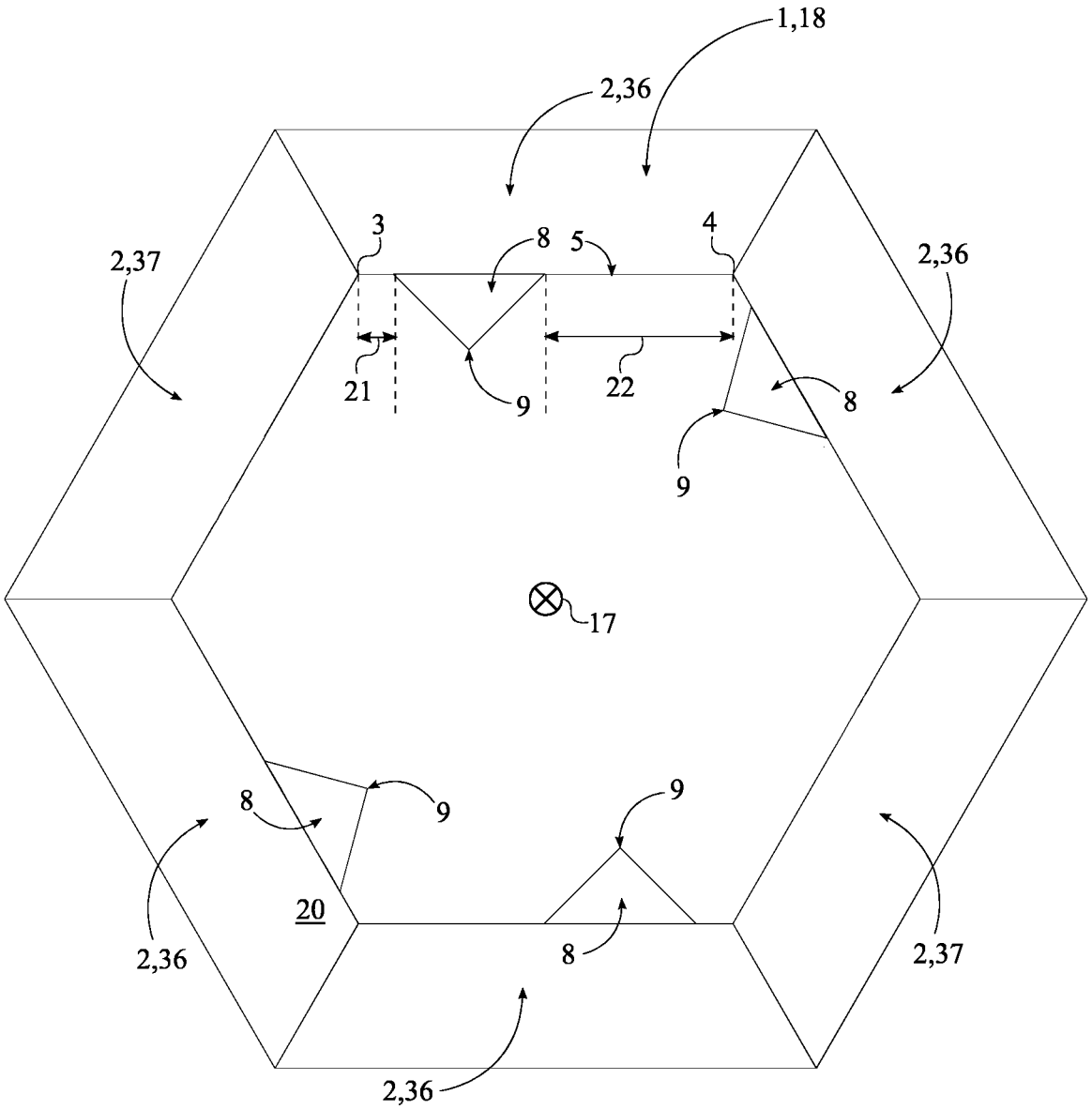
FIG. 20 is a front view of another separate alternative embodiment of the present invention in relation to FIG. 15, wherein engagement cavities are configured between flat sidewalls.
Figure 22:
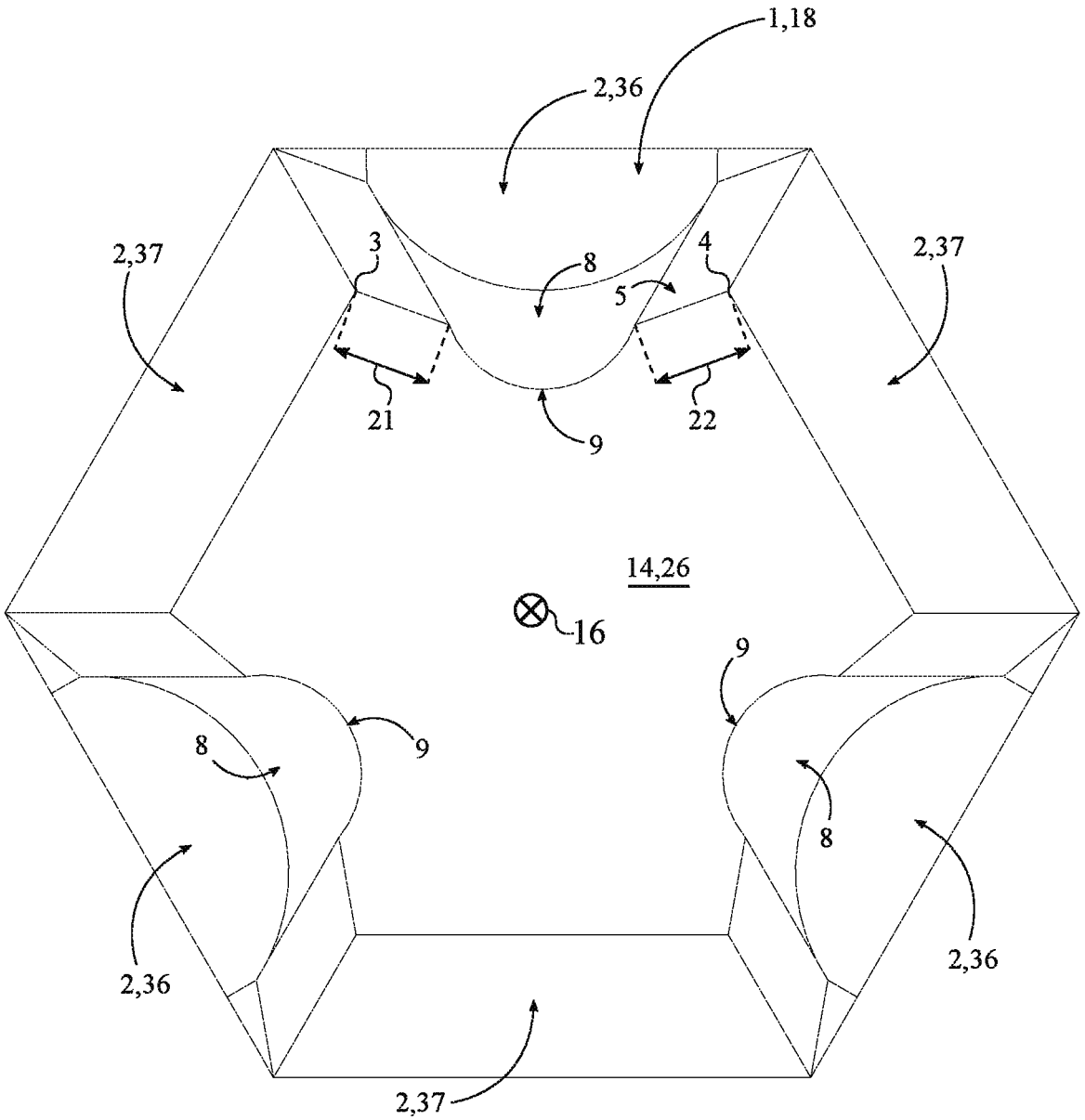
FIG. 22 is a front view of another separate alternative embodiment of the present invention in relation to FIG. 15, wherein engagement cavities are configured between flat sidewalls.

In another embodiment of the present invention, referring to FIG. 11, the engagement cavity 8 is centrally positioned on the bracing surface 5. In particular, the engagement cavity 8 is positioned offset from the second lateral edge 4 of the at least one specific sidewall 36 by a second distance 22. For central positioning, the first distance 21 is equal to the second distance 22, which is shown in FIG. 15. This positions the engagement cavity 8 to engage the internal lateral sidewall of the socket fastener and moves the torqueing stresses to or away from the fastener lateral corners to enhance the gripping function and prevent fastener rounding for the most efficient transfer of torque with the least possibility of slippage. Additionally, this embodiment may be used to rotate the socket fastener in either the clockwise or the counter-clockwise direction. It may also be desirable for the plurality of intermittent sidewalls 24 to be interspersed among the at least one specific sidewall 36 in an embodiment in which the first distance 21 is equal to the second distance 22, which is shown in FIG. 19 and FIG. 22.

In another embodiment of the present invention, the proportion between the first distance 21, the second distance 22, and the width of the engagement cavity 8 may be altered in order to achieve a dedicated clockwise or counterclockwise design. In one embodiment, the present invention is configured to be a clockwise drive bit. For this embodiment, the second distance 22 is greater than the first distance 21. In particular, the proportion between the first distance 21, the second distance 22, and the width of the engagement cavity 8 is 1:5:4, thus yielding a design of the present invention which grips and applies torque to the socket fastener in the clockwise direction. This design is used to screw in and secure the socket fastener. In another embodiment, the present invention is configured to be a counter-clockwise screw bit. For this embodiment, the first distance 21 is greater than the second distance 22. In particular, the proportion between the first distance 21, the second distance 22, and the width of the engagement cavity 8 is 5:1:4, thus yielding a design which grips and applies torque to the socket fastener in the counter-clockwise direction. This design is used to release and extract the socket fastener.

Figure 5:
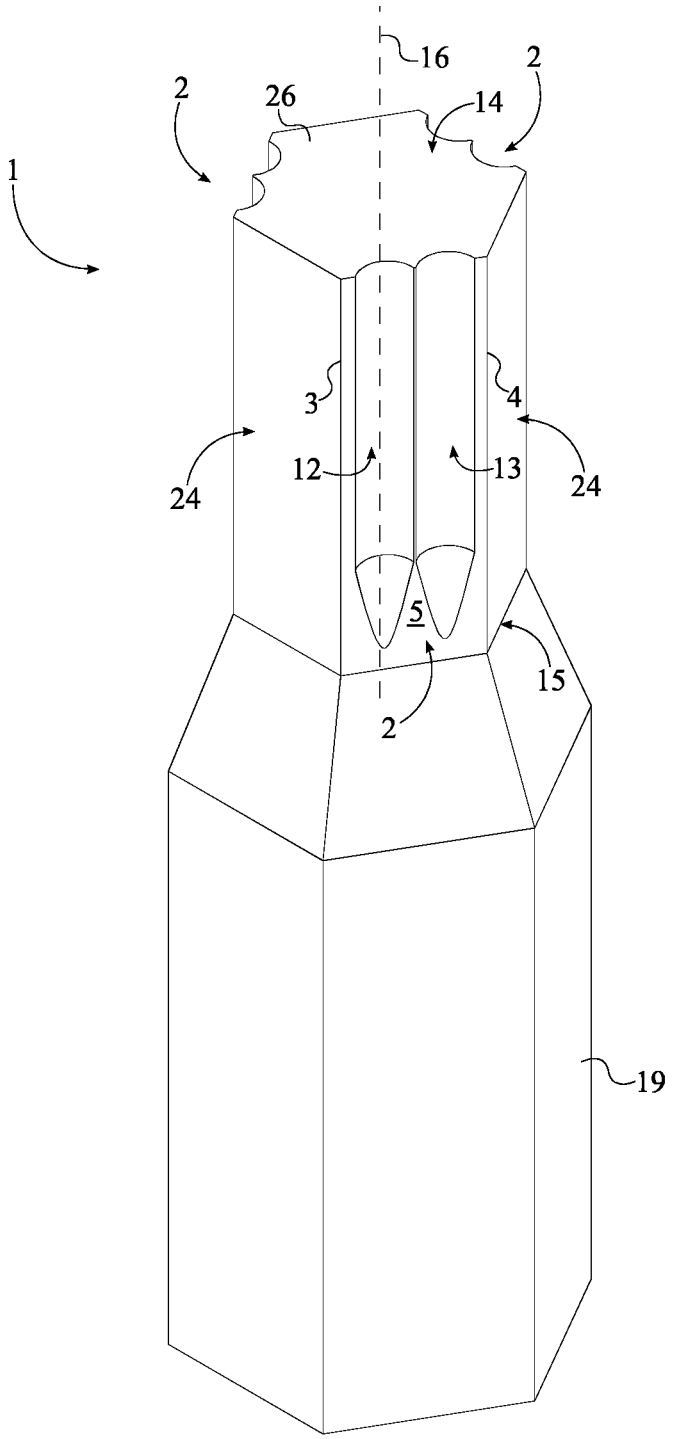
FIG. 5 is a perspective view of an alternative embodiment of the present invention.
Figure 10:
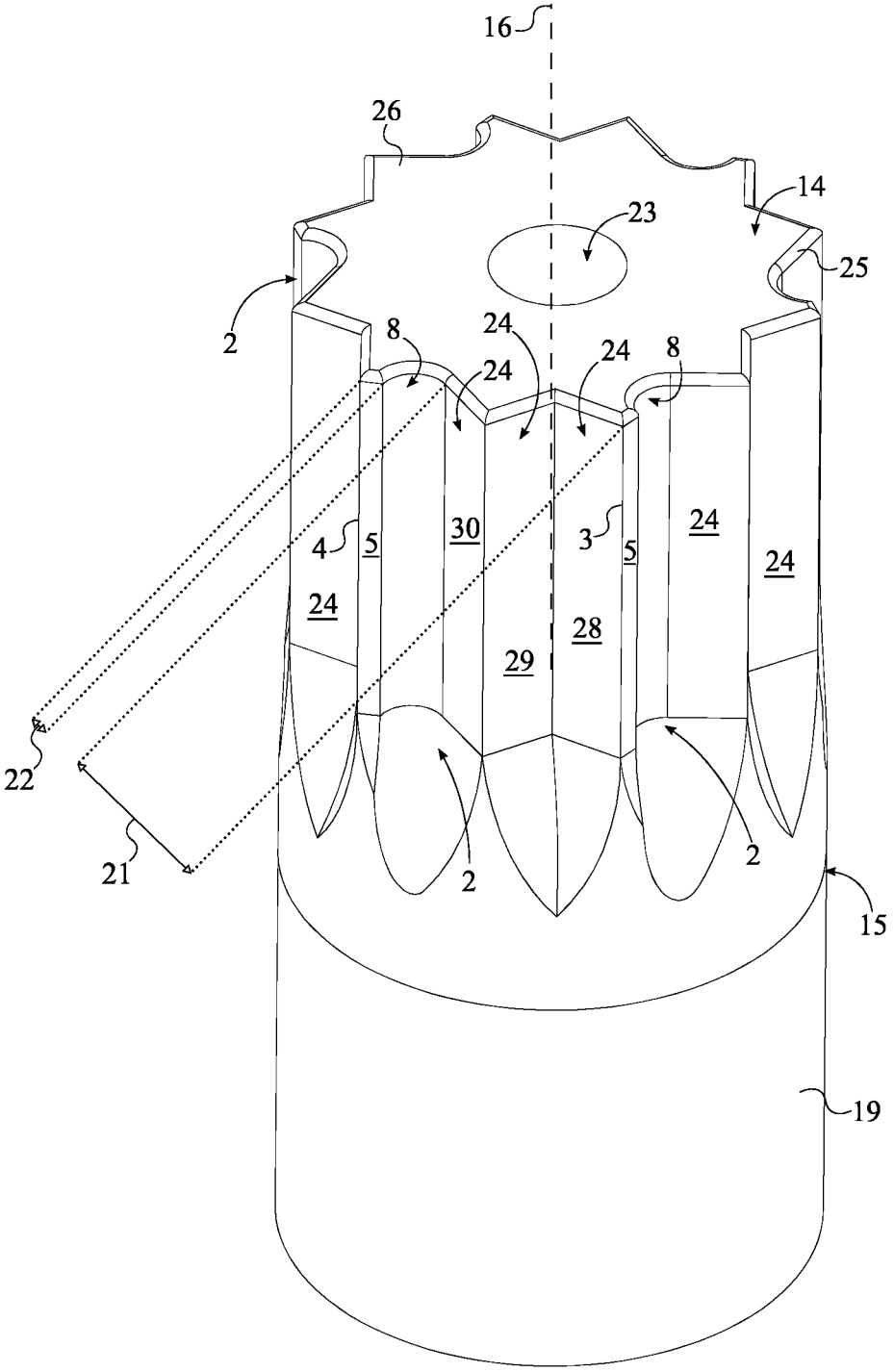
FIG. 10 is a perspective view of an alternative embodiment of the present invention.

Referring to FIG. 5 and FIG. 10, the present invention may also be implemented in a spline/square/other-polygonal bit design. More specifically, if the screw bit body 1 was a spline-type bit body, then the spline-type bit body would be able to transfers torque to the socket fastener through a multitude of protrusions. Thus, the screw bit body 1 may further comprise a plurality of intermittent sidewalls 24, as shown in FIG. 18-22. Each of the plurality of intermittent sidewalls 24 is a flat surface which engages the socket fastener like a traditional screw bit design. The plurality of intermittent sidewalls 24 is radially positioned about the rotation axis 16. Additionally, the plurality of intermittent sidewalls 24 is interspersed amongst the plurality of laterally-bracing sidewalls 2. The ratio between the plurality of laterally-bracing sidewalls 2 and the plurality of intermittent sidewalls 24 is subject to change to yield a variety of different screw bit designs. In one embodiment, the plurality of intermittent sidewalls 24 and the plurality of laterally-bracing sidewalls 2 radially alternate between each other. In another embodiment, there are three sidewalls from the plurality of intermittent sidewalls 24 in between each of the plurality of laterally-bracing sidewalls 2. Resultantly, this configuration places an engagement feature/tooth at every other protrusion of the screw bit body 1.

In an exemplary embodiment, a first intermittent sidewall 28, a second intermittent sidewall 29, and a third intermittent sidewall 30 among the plurality of intermittent sidewalls 24 are interspersed on a corresponding laterally-bracing sidewall among the plurality of laterally-bracing sidewalls 2, as represented in FIG. 10. The first intermittent sidewall 28, second intermittent sidewall 29, and third intermittent sidewall enable effective connection with a fastener while providing the desired space that prevents mechanical wear and fatigue on parts. The first intermittent sidewall 28 and the second intermittent sidewall 29 are perpendicularly positioned to each other. This arrangement results in a 90-degree angle, which may be optimal for certain applications. The third intermittent sidewall 30 is located in between the at least one engagement cavity 8 of the corresponding laterally-bracing sidewall and the second intermittent sidewall 29. Thus, the third intermittent sidewall 30 provides structural support for the at least one engagement cavity 8 during preferred usage of the present invention.

It may be mechanically advantageous or preferable to provide different configurations of the at least one engagement cavity 8, such that the engagement cavity 8 may be present on multiple sidewalls of the at least one screw bit body 1. To provide for this, the at least one specific sidewall 36 may be a plurality of specific sidewalls. This arrangement allows the plurality of specific sidewalls to encompass different patterns around the screw bit body 1. Furthermore, the at least one engagement cavity 8 may be a plurality of engagement cavities. In this way, each specific sidewall may be appropriately shaped with an engagement cavity 8. Finally, each of the plurality of engagement cavities 8 may extend normal and into the bracing surface 5 of a corresponding specific sidewall from the plurality of specific sidewalls. Thus, each specific sidewall may be cavitated, or otherwise shaped, with a cavity of the plurality of engagement cavities 8.

To account for this, the plurality of laterally-bracing sidewalls may further comprise at least one flat sidewall 37. The at least one flat sidewall 37 denotes a sidewall of the plurality of laterally-bracing sidewalls 2 that does not contain specific cavity features. The at least one flat sidewall 37 may be positioned adjacent to the at least one specific sidewall 36. In this way, flat sidewalls may be positioned between each sidewall of the at least one specific sidewall 36, thus allowing different configurations of cavitated and flat sidewalls.

Figure 6:
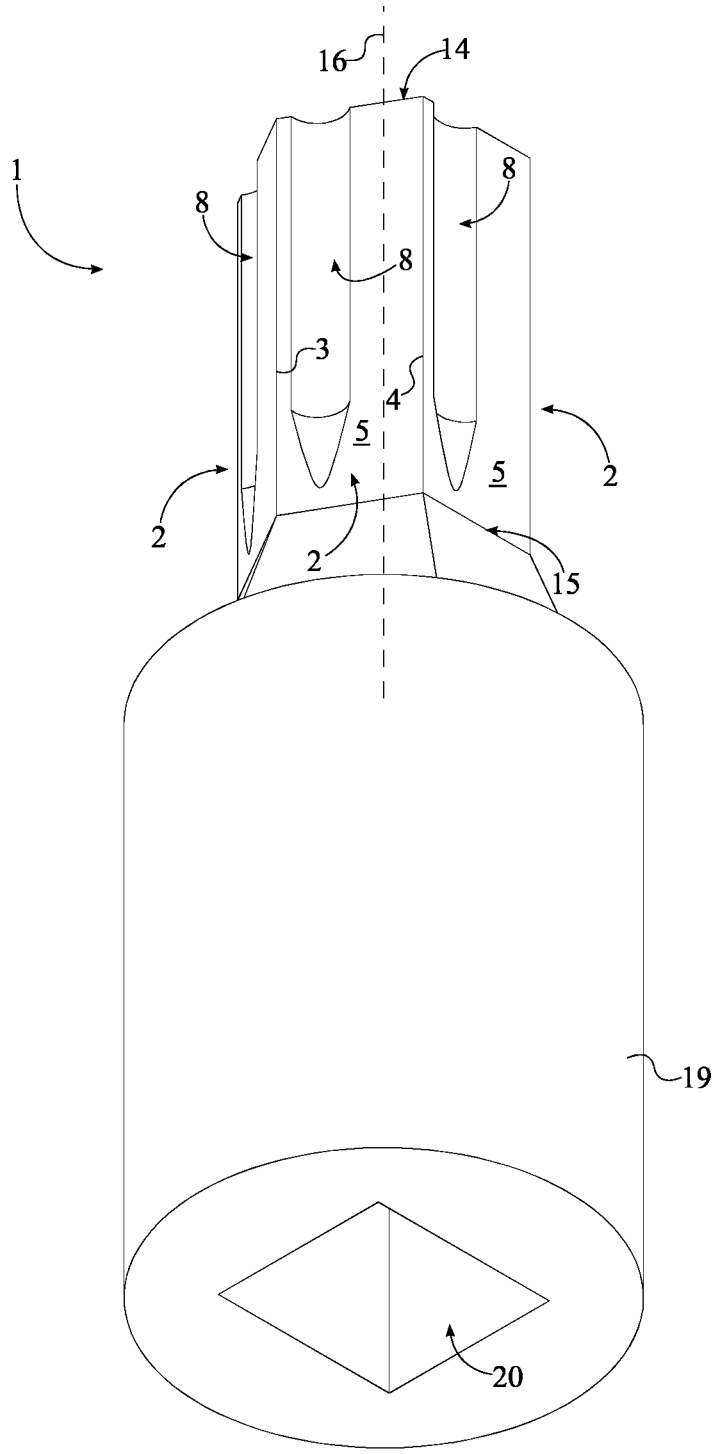
FIG. 6 is a bottom perspective of the present invention.

In another embodiment, referring to FIG. 6, the present invention further comprises an engagement bore 20. The engagement bore 20 allows the present invention to be attached to a male attachment member of an external torque tool, such as a socket wrench or a screwdriver. The engagement bore 20 extends into the attachment body 19 along the rotation axis, opposite the screw bit body 1. The engagement bore 20 is shaped to receive a male attachment member of a socket wrench; the preferred shape is square as the majority of socket wrenches utilize a square attachment member. In this embodiment, the preferred attachment body 19 is cylindrical shaped. In alternative embodiments, the shape and design of the engagement bore 20 and the attachment body 19 may vary to be adaptable to different torque tool designs and different attachment means.

Figure 2:
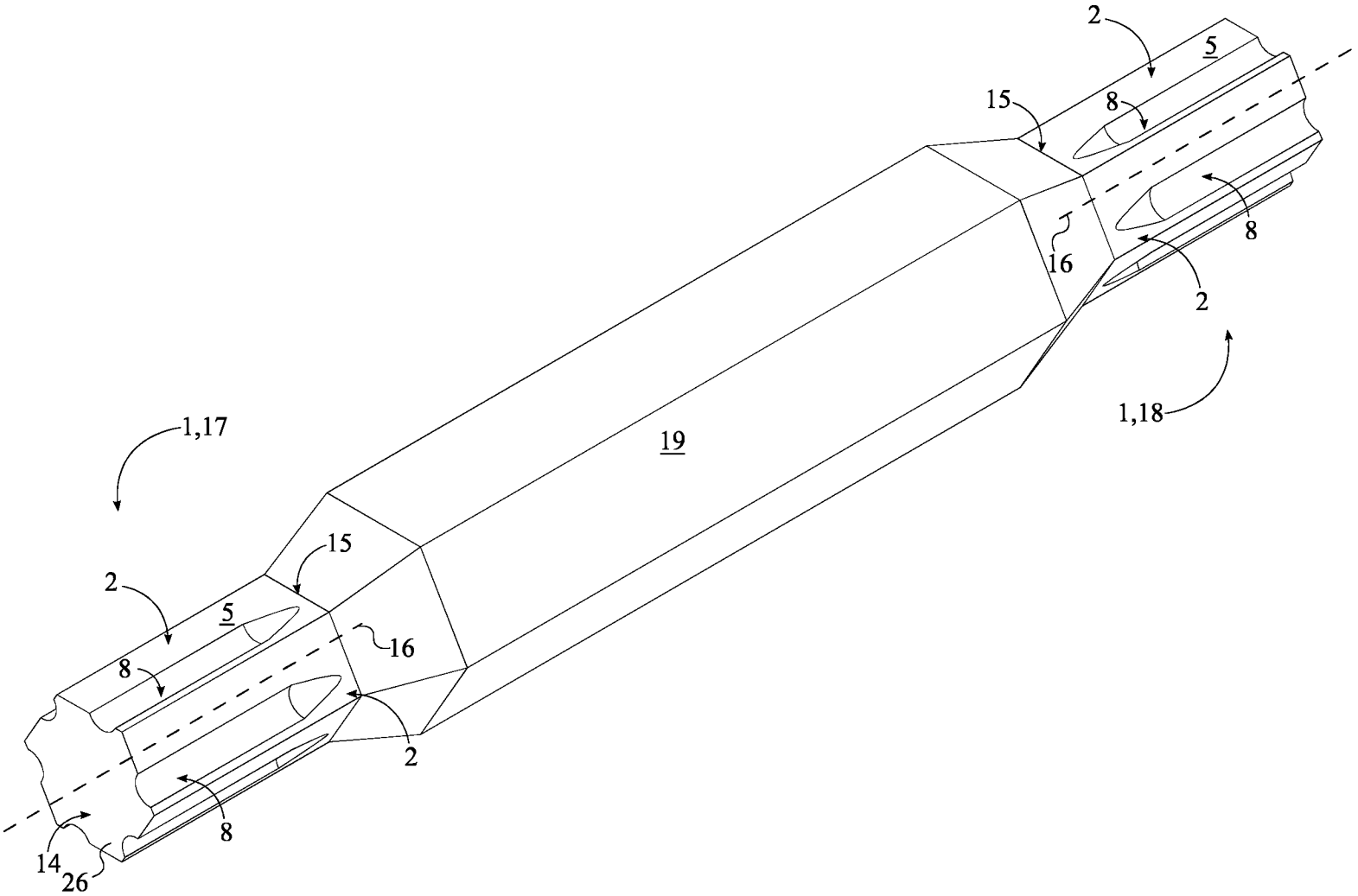
FIG. 2 is a perspective view of an alternative embodiment of the present invention.
Figure 4:
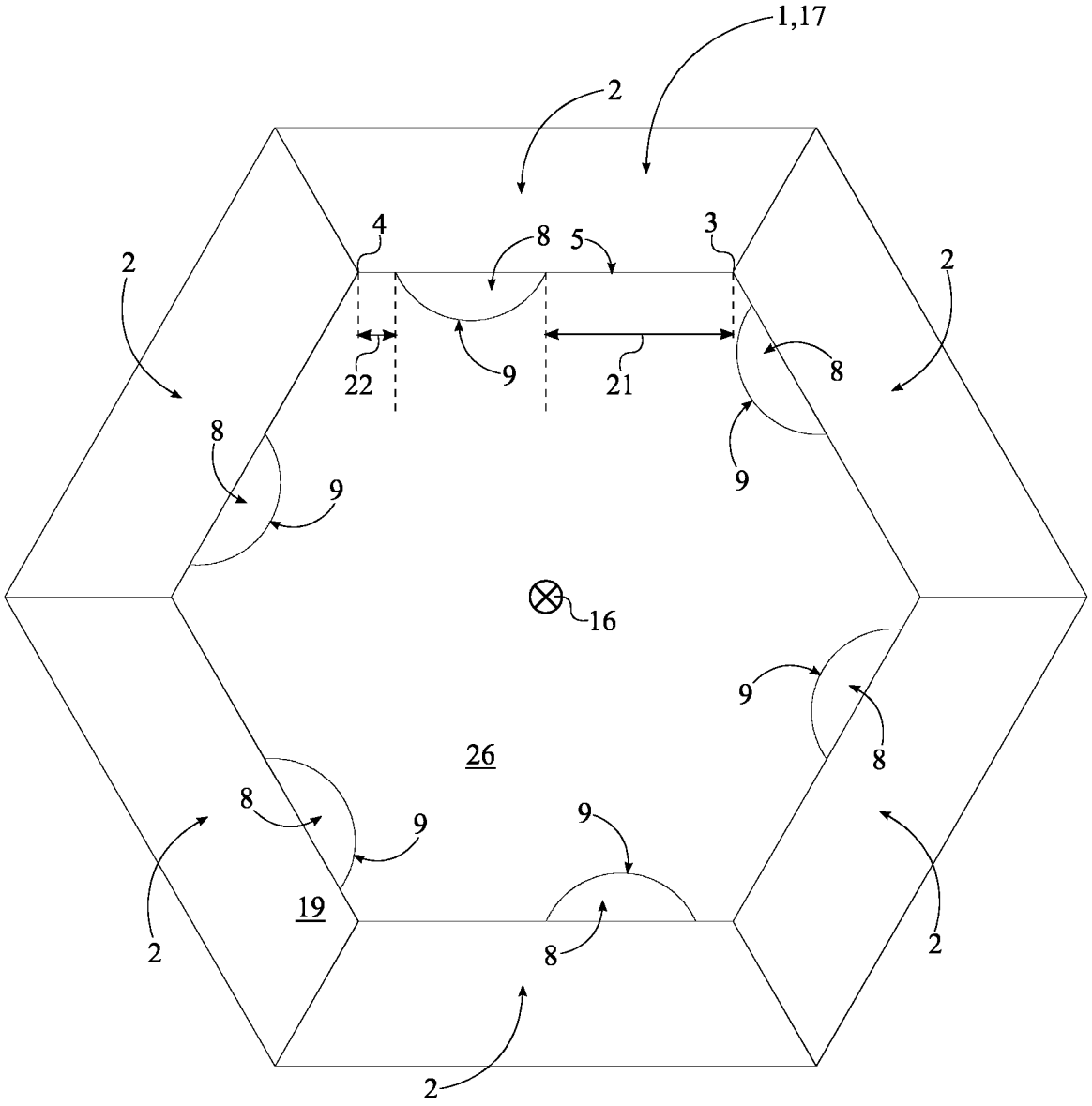
FIG. 4 is a rear view of the alternative embodiment of the present invention in FIG. 2.

In one embodiment, referring to FIG. 2, the present invention is implemented as a dual sided screw bit, thus providing both a clockwise and a counter-clockwise configuration simultaneously in a single tool. In this embodiment, the at least one screw bit body 1 comprises a first screw bit body 17 and a second screw bit body 18. The attachment body 19 preferably has a hexagonal cross-section. The attachment body 19 is centrally positioned around and along the rotation axis 16 of the first screw bit body 17 such that the rotation axis of the attachment body 19 and the rotation axis 16 of the first screw bit body 17 are coincidentally aligned. Additionally, the attachment body 19 is connected adjacent to the second base 15 of the first screw bit body 17. The second screw bit body 18 shares the attachment body 19 with the first screw bit body 17. Thus, the second screw bit body 18 is concentrically positioned with the first screw bit body 17. Additionally, the second screw bit body 18 is positioned adjacent to the attachment body 19, opposite the first screw bit body 17, similar to traditional double-sided screw bit designs. Similar to the first screw bit body 17, the attachment body 19 is connected to the second base 15 of the second screw bit body 18. The first screw bit body 17 is designed to screw in a socket fastener, the clockwise configuration. For this, referring to FIG. 3, the second distance 22 of the first screw bit body 17 is greater than the first distance 21 of the first screw bit body 17. This positions the additional gripping point of the first screw bit body 17 adjacent to the first lateral edge 3 of the first screw bit body 17. The second screw bit body 18 is designed to unscrew/extract the socket fastener, i.e. the counter-clockwise configuration. Referring to FIG. 4, the first distance 21 of the second screw bit body 18 is greater than the second distance 22 of the second screw bit body 18. This positions the additional gripping point of the second screw bit body 18 adjacent to the second lateral edge 4 of the second screw bit body 18.

Figure 21:
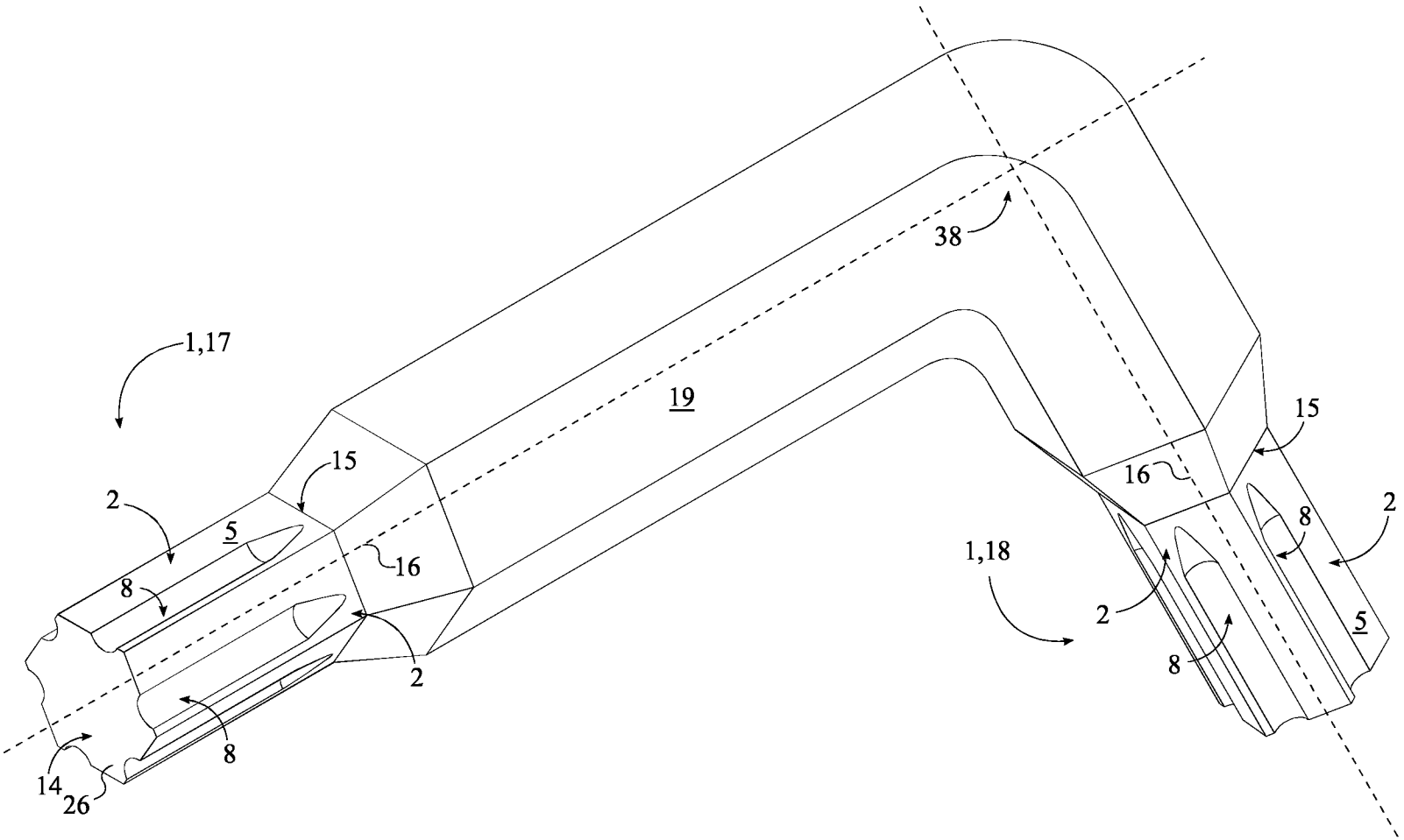
FIG. 21 is a perspective view of another separate alternative embodiment of the present invention in relation to FIG. 2, wherein opposing bit bodies are positioned at an angle to each other.

In a further embodiment, the dual-sided screw bit may benefit from being positioned or oriented with a bend between the first screw bit body 17 and the second screw bit body 18, as is commonly seen in hex keys and similar wrench tools. To this end, the second screw bit body 18 may be oriented at an attachment angle 38 from the first screw bit body 17, as represented in FIG. 21. This arrangement enables the user to utilize the first screw bit body 17 as a handle while turning an external screw with the second screw bit body 18.

In another embodiment of the present invention, referring to FIG. 5, the at least one engagement cavity 8 comprises a first cavity portion 12 and a second cavity portion 13. This embodiment is an alternative configuration which yields a clockwise and counter-clockwise configuration. In particular, the first cavity portion 12 and the second cavity portion 13 are oriented parallel and offset to each other. The first cavity portion 12 is positioned adjacent and offset to the first lateral edge 3 and the second cavity portion 13 is positioned adjacent and offset to the second lateral edge 4. This allows the user to rotate the present invention either in the clockwise or counter-clockwise rotation without removing the present invention from the torque tool while still taking advantage of the additional gripping point(s). In this embodiment, it is preferred that the present invention further comprises the plurality of intermittent sidewalls 24, wherein the plurality of intermittent sidewalls 24 is interspersed amongst the plurality of laterally-bracing sidewalls 2. As a consequence of this embodiment, the triangular profile may be a plurality of triangular profiles arranged along the plurality of laterally-bracing sidewalls 2. Such an embodiment enables enhanced adaptation to various high-stress uses of the present invention.

Figure 7:
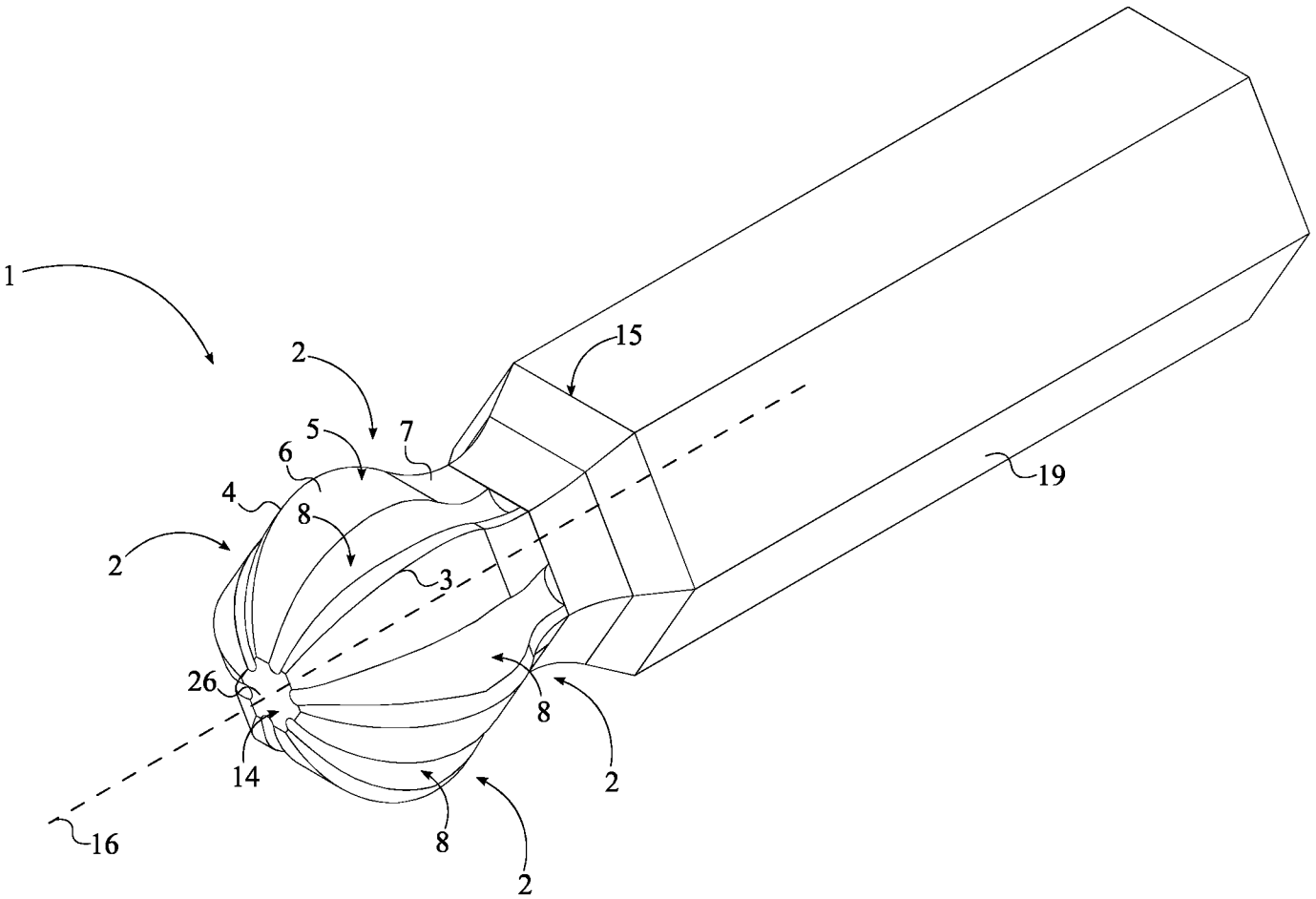
FIG. 7 is a perspective view of an alternative embodiment of the present invention.

Referring to FIG. 7, in an alternative embodiment, the present invention is implemented as a ball-end screw bit. In this embodiment, the bracing surface 5 for each of the plurality of laterally-bracing sidewalls 2 comprises a convex portion 6 and a concave portion 7. The convex portion 6 and the concave portion 7 delineate a curved surface such that, overall, the plurality of laterally-bracing sidewalls 2 forms a ball-like shape. The convex portion 6 is positioned adjacent to the first base 14 such that the convex portion 6 from each of the plurality of laterally-bracing sidewalls 2 forms the body of the ball-like shape. The concave portion 7 is positioned adjacent to the convex portion 6, opposite to the first base 14 such that the concave portion 7 from each of the plurality of laterally-bracing sidewalls 2 further forms the ball-like shape and provides clearance for when the screw bit body 1 is engaged to the socket fastener at an angle. The convex portion 6 and the concave portion 7 are oriented along the rotation axis 16 of the screw bit body 1, and thus the length of the screw bit body 1, to position the ball-like shaped terminally on the screw bit body 1. It is preferred that the curvature, length, and height of the concave portion 7 and the convex portion 6 is identical. Additionally, it is preferred that the engagement cavity 8 extends along the whole length of the convex portion 6 and the concave portion 7. Thus, additional gripping is provided along the screw bit body 1, regardless of the angle between the socket fastener and the screw bit body 1.

Referring to FIG. 10, in one embodiment, the present invention is implemented as a tamper-resistant screw bit. In particular, the present invention further comprises a pin-in security hole 23 which interlocks with a complimentary post within a unique socket fastener. Thus, a set of unique socket fasteners and a unique-key screw bit may be sold, utilized, or manufactured to ensure tamper proof design. This type of interlocking design is used for security reasons, preventing unauthorized personnel from accessing certain socket fasteners. The pin-in security hole 23 is concentrically positioned with the rotation axis 16 of the screw bit body 1. Additionally, the pin-in security hole 23 extends into the screw bit body 1 from the first base 14. The size, depth, and profile of the pin-in security is subject to change to meet the needs and specifications of the user.

Figure 12:
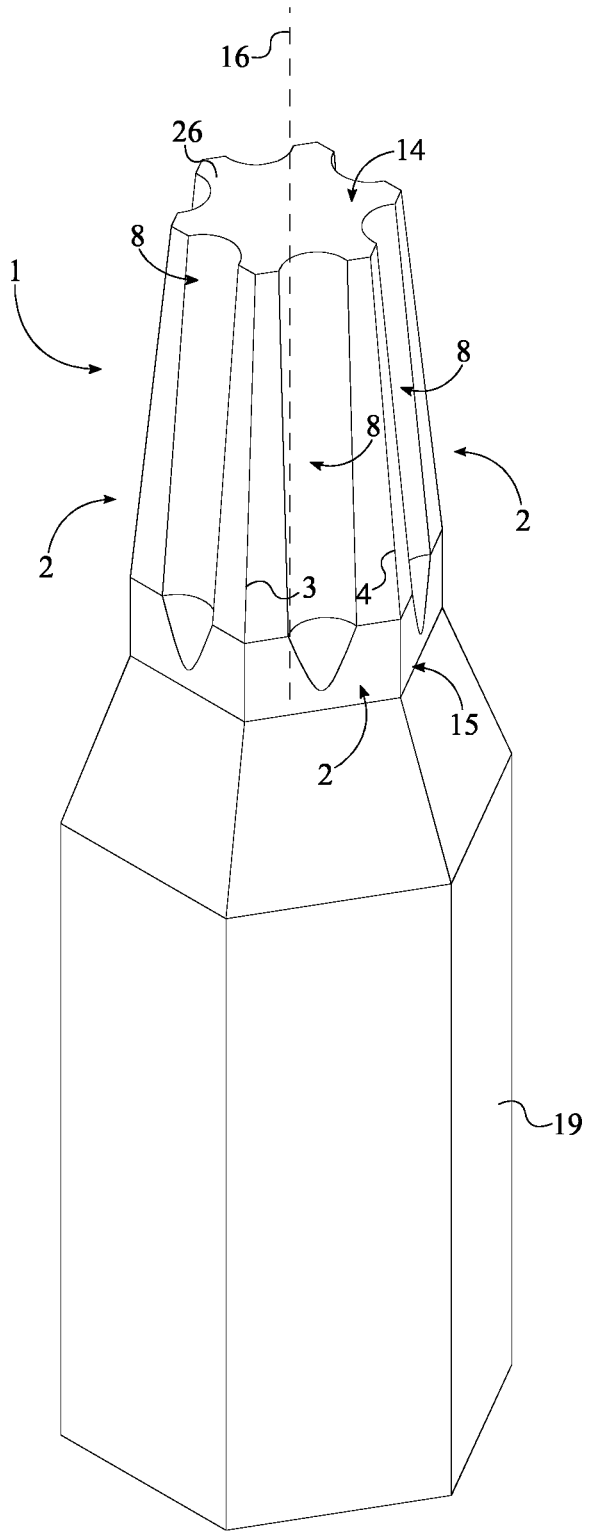
FIG. 12 is a perspective view of an alternative embodiment of the present invention.

In one embodiment, referring to FIG. 11, the present invention includes additional features in order to guide the screw bit body 1 into the socket fastener. In particular, a lateral edge 25 between the first base 14 and each of the plurality of laterally-bracing sidewalls 2 is chamfered which aids the user in interlocking the screw bit body 1 within the socket fastener. Referring to FIG. 12, in another embodiment, the present invention is implemented in an alternative design. In this embodiment, the screw bit body 1 is tapered from the second base 15 towards the first base 14. The degree of tapering is subject to change to meet the needs and requirements of the user. In yet another embodiment as shown in FIG. 22, the present invention is a screw bit body that tapers from the second base 15 to first base 14 including at least one flat sidewall 37 that is tapered adjacent to at least one specific sidewall 36 that is tapered. In other words, the at least one specific sidewall 36 and the at least one flat sidewall 37 are not perpendicular with the first base 14, as shown in FIG. 22. Some embodiments are generally more advantageous for leverage and resistance of mechanical wear during use. To this end, the at least one engagement cavity 8 is positioned offset from the first lateral edge 3 of the at least one specific sidewall 36 by a first distance 21, as shown in FIG. 22. Resultantly, a gripping point is created by the at least one engagement cavity 8 and the bracing surface 5. The first portion 33 of the bracing surface 5 of the at least one specific sidewall 36 may be positioned along the first distance 21. In this way, the first distance 21 may denote area including a segment of the first portion 33. A width distance 35 of the at least one engagement cavity 8 may be positioned parallel to the bracing surface 5. This arrangement allows the width distance 35 to be parallel to the first distance 21. The width distance 35 may be greater than the first distance 21. In this way, the at least one engagement cavity 8 is ensured to span across a significant portion of the useful area for the bracing surface 5.

The first portion 33 of the present invention may take a variety of shapes as may be found to be advantageous under various stresses or use cases. To ensure an appropriate shape of the at least one engagement cavity 8, the first portion 33 may be a shape selected from the group consisting of: straight line, concave, and convex, as shown in FIG. 14-17. Any of these shapes could provide optimal support during use, improving the duration of the present invention.

The bracing surface 5 may further benefit from a more complex shape or arrangement. To enable this, the bracing surface 5 may further comprise a second portion 34, as shown in FIG. 22. The second portion 34 is a section of the bracing surface 5 positioned along a second distance 22, which arranges the second portion 34 adjacent to the second lateral edge 4. The at least one engagement cavity 8 may be positioned offset from the second lateral edge 4 of the at least one specific sidewall 36 by the second distance 22. The second distance 22 denotes the space opposite the first distance 21 between the at least one engagement cavity 8 and the second lateral edge 4. The second portion 34 of the bracing surface 5 of the at least one specific sidewall 36 may be positioned along the second distance 22. In this way, the second distance 22 may denote an area including a segment of the second portion 34. The second portion 34 may be a shape selected from the group consisting of: straight line, concave, and convex. In this way, the second portion 34 may be adapted to best address potential mechanical fatigue to the present invention. Furthermore, the at least one engagement cavity 8 may taper perpendicular to a rotational axis from a position adjacent to the first distance 21 or the second distance 22 towards a lateral edge. This arrangement allows for optimal application of force during rotational usage of the present invention. A length of the first distance 21 may be equal or dissimilar to a length of the second distance 22. A bracing surface geometric plane positioned along the bracing surface 5, adjacent to the at least one engagement cavity 8, is preferably colinear with a lateral edge geometric plane that extends from the first lateral edge 3 to second lateral edge 4; however, in some embodiments, the bracing surface geometric plane may be offset from, rather than colinear with, the lateral edge geometric plane, as shown in FIG. 22. A width distance of the flat sidewall 37 may be less, equal or greater than a width distance of the specific sidewall 36. A width of the first portion 33 and a width of the second portion 34 may taper from the first base 14 to the second base 15. Referring to FIG. 22, in one embodiment of the present invention, the entire cross-section 9 of the engagement cavity 8 is preferably a partially-circular profile. Additionally, the partially-circular profile is concave along a direction from the first lateral edge 3 to the second lateral edge 4. The partially-circular profile ensures that there are little to no high stress points in the screw bit body 1, thus increasing the overall longevity of the tool. In the preferred embodiment, the bracing surface 5 of the at least one specific sidewall 36 is connected to the bracing surface 5 of at least one flat sidewall 37 at an obtuse angle. The attachment body 19 allows the present invention to be attached to an external torque tool, thus allowing torque force to be applied to the socket fastener through the screw bit body 1. The attachment body 19 is centrally positioned around and along a rotation axis 16 of the screw bit body 1 such that the rotation axis of the attachment body 19 and the rotation axis 16 of the screw bit body 1 are coincidentally aligned. Additionally, the attachment body 19 is connected adjacent to the second base 15.

In many circumstances, the user may wish to provide torsional pressure from different angles within an external screw. To provide for this, the second portion 34 of the bracing surface 5 of the at least one specific sidewall 36 may be positioned at a portion angle from the first portion 33 of the bracing surface 5 of the at least one specific sidewall 36, as shown in FIG. 22. This arrangement ensures that alternative shapes of external screw holes may be accurately filled by, and are within the scope of, the present invention.

In other embodiments, the present invention may be implemented in the form of a socket for tightening or loosening of bolts and other similar fasteners. For this, the screw bit body 1 is implemented as a cavity traversing into a cylinder, similar to traditional socket designs.

Although the invention has been explained in relation to its preferred embodiment, it is to be understood that many other possible modifications and variations can be made without departing from the spirit and scope of the invention as hereinafter claimed.

What is claimed is:

1. A multi-grip screw apparatus comprising:

at least one screw bit body;

an attachment body;

the at least one screw bit body comprising a plurality of laterally-bracing sidewalls, at least one flat sidewall, a first base, a second base, and at least one engagement cavity;

the plurality of laterally-bracing sidewalls comprising a first lateral edge, a second lateral edge, and a bracing surface;

the plurality of laterally-bracing sidewalls being radially positioned about a rotation axis of the at least one screw bit body;

the first lateral edge and the second lateral edge being positioned opposite to each other across the bracing surface;

the first lateral edge and the second lateral edge being angular in shape formed by intersecting straight lines;

the at least one engagement cavity extending normal and into the bracing surface of at least one specific sidewall from the plurality of laterally-bracing sidewalls;

the at least one flat sidewall being positioned adjacent to the at least one specific sidewall;

the at least one engagement cavity extending into the at least one screw bit body from the first base towards the second base;

an entire cross-section of the at least one engagement cavity being parallel to the first base and the second base; and the attachment body being connected adjacent to the second base.

2. The multi-grip screw apparatus as claimed in claim 1, wherein the at least one screw bit body tapers from the first base to the second base.

3. The multi-grip screw apparatus as claimed in claim 1, wherein the at least one screw bit body tapers from the second base towards the first base.

4. The multi-grip screw apparatus as claimed in claim 1 comprising:

the at least one engagement cavity being positioned offset from the first lateral edge of the at least one specific sidewall by a first distance;

a first portion of the bracing surface of the at least one specific sidewall being positioned along the first distance; and the first portion being a shape selected from the group consisting of: straight line, concave, and convex.

5. The multi-grip screw apparatus as claimed in claim 1 comprising:

the at least one engagement cavity being positioned offset from the second lateral edge of the at least one specific sidewall by a second distance;

a second portion of the bracing surface of the at least one specific sidewall being positioned along the second distance; and the second portion being a shape selected from the group consisting of: straight line, concave, and convex.

6. The multi-grip screw apparatus as claimed in claim 1 comprising:

a second portion of the bracing surface of the at least one specific sidewall being positioned at a portion angle from a first portion of the bracing surface of the at least one specific sidewall.

7. The multi-grip screw apparatus as claimed in claim 1 comprising:

the at least one engagement cavity being positioned offset from the first lateral edge of the at least one specific sidewall by a first distance;

the at least one engagement cavity being positioned offset from the second lateral edge of the at least one specific sidewall by a second distance; and the first distance being equal to the second distance.

8. The multi-grip screw apparatus as claimed in claim 1 comprising:

the at least one screw bit body further comprising a plurality of intermittent sidewalls;

the plurality of intermittent sidewalls being radially positioned about the rotation axis; and the plurality of intermittent sidewalls being interspersed amongst the plurality of laterally-bracing sidewalls.

9. The multi-grip screw apparatus as claimed in claim 1, wherein a lateral edge between the first base and each of the plurality of laterally-bracing sidewalls is chamfered.

10. The multi-grip screw apparatus as claimed in claim 1, wherein the at least one engagement cavity tapers from the first base to the second base.

* * * * *